US005445324A

United States Patent [19]

Berry et al.

[11] Patent Number: 5,445,324

[45] Date of Patent: Aug. 29, 1995

[54] PRESSURIZED FEED-INJECTION SPRAY-FORMING APPARATUS

[75] Inventors: Ray A. Berry; James R. Fincke; Kevin M. McHugh, all of Idaho Falls, Id.

[73] Assignee: United States Department of Energy, Washington, D.C.

[21] Appl. No.: 188,351

[22] Filed: Jan. 28, 1994

Related U.S. Application Data

[63] Continuation of Ser. No. 10,089, Jan. 27, 1993, abandoned.

[51] Int. Cl.[6] ..... B05B 1/24

[52] U.S. Cl. ..... 239/99; 239/135; 239/307; 239/373; 427/422; 222/593

[58] Field of Search ..... 239/80, 74, 85, 13, 239/9, 134, 133, 137, 336, 135, 654, 427.5, 373, 425, 304, 307, 433, 434, 99; 222/593, 603; 266/217, 202; 219/121.48, 121.50, 121.51, 121.37; 427/422; 261/78.2, 76, 116, 118, DIG. 78

[56] References Cited

U.S. PATENT DOCUMENTS

| | | | |
|---|---|---|---|
| 945,338 | 1/1910 | Mikorey | 239/135 |
| 1,164,008 | 12/1915 | Moore | 427/422 |
| 1,555,797 | 9/1925 | Grammer | 239/99 |
| 1,642,418 | 9/1927 | Kosanda et al. | 239/134 X |
| 1,919,153 | 7/1933 | Andrews | 239/365 |
| 2,148,986 | 2/1939 | Hoyt | 239/135 X |
| 2,327,787 | 6/1943 | Brennan | 427/422 |
| 2,855,330 | 10/1958 | Griswold et al. | 427/422 X |
| 3,109,594 | 11/1963 | Pletcher | 239/347 X |
| 3,207,369 | 9/1965 | Rossi | 239/135 X |
| 3,411,714 | 11/1968 | Peters et al. | 239/307 X |
| 3,442,453 | 5/1969 | Whitehouse | 239/304 X |
| 3,476,247 | 8/1976 | Carmelo | 239/346 X |
| 3,694,182 | 7/1972 | Roche | 239/347 X |
| 3,776,462 | 12/1973 | Payne | 239/134 |
| 4,289,807 | 9/1981 | Christensen et al. | 239/13 X |
| 4,770,827 | 9/1988 | Fischer | 427/427 X |
| 4,909,914 | 3/1990 | Chiba et al. | 219/121.5 X |
| 4,919,853 | 4/1990 | Alvarez et al. . | |

FOREIGN PATENT DOCUMENTS

| | | | |
|---|---|---|---|
| 547654 | 10/1955 | Italy | 239/135 |
| 161738 | 4/1921 | United Kingdom | 239/135 |

OTHER PUBLICATIONS

U.S. patent application Ser. No. 623,851 to Ploger et al.

U.S. patent application Ser. No. 599,773 to Ploger et al.

"Development of a Spray-Forming Process for Steel. Final Program Report", William DuBroff, Program Coordinator.

*Primary Examiner*—Andres Kashnikow

*Assistant Examiner*—Kevin P. Weldon

*Attorney, Agent, or Firm*—Robert J. Fisher; Hugh W. Glenn; William R. Moser

[57] ABSTRACT

A spray apparatus and method for injecting a heated, pressurized liquid in a first predetermined direction into a pressurized gas flow that is flowing in a second predetermined direction, to provide for atomizing and admixing the liquid with the gas to form a two-phase mixture. A valve is also disposed within the injected liquid conduit to provide for a pulsed injection of the liquid and timed deposit of the atomized gas phase. Preferred embodiments include multiple liquid feed ports and reservoirs to provide for multiphase mixtures of metals, ceramics, and polymers.

18 Claims, 16 Drawing Sheets

PRESSURIZED FEED-INJECTION SPRAY-FORMING APPARATUS

CONTRACTUAL ORIGIN OF THE INVENTION

The United States Government has rights in this invention pursuant to Contract No. DE-AC07-76ID01570 between the United States Department of Energy and EG&G Idaho, Inc.

This is a continuation of application ser. No. 08/010,089, filed Jan. 27, 1993.

BACKGROUND OF THE INVENTION

1. Field of the Invention

The present invention relates to means and method for spray-forming a metal, polymer, or metal/polymer matrix deposit on a substrate and, in particular, to means and method for pressurized injection liquid-feed spraying.

2. Discussion of the Prior Art

This invention relates to a method and apparatus for producing a spray of finely atomized liquid droplets of controlled size distribution, velocity, heat content, flux, and flow pattern. The primary function of the device is to spray form near-net-shape solids and coatings of metals, polymers, and composite materials by directing a spray of atomized droplets onto a suitably shaped substrate or mold. Powders of these materials are produced by allowing the droplets to solidify in-flight.

Tremendous growth in the science and technology of atomization has occurred in the past decade. The discipline is now recognized as a major international field of research. Atomization of liquids involves the disintegration of a bulk liquid into fine droplets, and devices used to generate atomized sprays are designated as atomizers or nozzles. Methodologies for generating sprays include discharging a liquid at high velocity into a relatively slow-moving stream of air or other gas, the ejection of a liquid from the periphery of a cup or disk rotating at high velocity, and the exposure of a relatively slow-moving liquid to a high-velocity gas. The latter approach is employed in the present invention.

Atomized sprays find use in a wide range of applications including spray-drying, cooling, combustion, painting, and powdered metal production. Spray-forming is another application of atomized sprays but differs in that atomized droplets of engineered alloys, plastics, and composite materials are spray-deposited onto a suitably shaped substrate or pattern to produce a free-standing, near-net-shape, or net-shape solid. The properties of the spray-formed product reflect the interplay of the characteristics of the spray plume and substrate onto which the spray is deposited. Spray-forming can offer unique opportunities for simplifying materials processing without sacrificing and, oftentimes substantially improving, product quality. In addition to near-net-shape fabrication capabilities, spray-forming is applicable to a wide range of metals and nonmetals and offers property improvements through rapid solidification (e.g., in the case of metals, refined microstructures, extended solid solubilities, and reduced segregation). Economic benefits result from process simplification and the elimination of unit operations. In addition to general spray-forming applications, the present invention has also been used to form coatings and powders of metals, polymers, and composite materials.

This instant invention is an improvement to the spray-forming process which has been developed at the Idaho National Engineering Laboratory (INEL), which is currently referred to as the Controlled Aspiration Process (CAP). The CAP process is set forth in detail in U.S. Pat. No. 4,919,853 issued to Alvarez and Watson on Apr. 24, 1990, and entitled "Apparatus And Method For Spraying Liquid Materials", the disclosure of which is herein incorporated by reference. The CAP process of spray-forming metals aspirates a molten metal into the throat of a converging/diverging gas nozzle, where the liquid is atomized into a directed spray of rapidly cooling droplets. The gas flowing in the nozzle may be ambient air or an inert gas which then accelerates the aspirated molten metal droplets toward a suitable substrate, against which the droplets impact before completely solidifying. Under ideal operating conditions, the incident metal consolidates into a suitable deposit.

Some problems occur with reproducible ideal operating conditions. In some instances, the molten metal does not atomize into a uniform cross-section spray. Aspiration only works within a narrow range of gas supply pressures. This difficulty is heightened by liquids within certain properties, such as, for example, kinematic high viscosity. Aspiration also limits the location of the liquid feed tube within the throat area of the nozzle. Aspiration limits particle size, particle size distributions, particle velocities, particle cooling rates, nozzle geometry, etc. Accordingly, it would be desirable to have an alternative means and method for atomizing the molten metal within a spray nozzle, as to provide for greater flexibility for controlling the properties of the spray which in turn dictate the properties of the spray-formed deposit.

SUMMARY OF THE INVENTION

This invention provides a method and apparatus for producing a spray of finely atomized liquid droplets of metals, polymers, and composite materials by gas atomization of the bulk liquid. Independent control of the atomizing gas velocity, liquid-feed rate, atomizing gas temperature, and other parameters provides flexibility for controlling the atomization behavior of the liquid, the gas/liquid heat-transfer behavior, and the multiphase flow behavior of the spray.

The primary function of the invention is to spray-form near-net-shape solids and coatings of metals, polymers, and composite materials by directing a spray of atomized droplets onto a suitably shaped substrate or mold. Control of size distribution, velocity, and heat content of the atomized droplets as well as the flux, and flow pattern of the spray are important attributes of the invention since they critically influence the properties of the spray-formed product. Powders of metals, polymers, and composite materials are also produced by allowing the atomized droplets to solidify in-flight.

Atomization of the bulk liquid is accomplished by pressure feeding the liquid through one or more orifice into the flow channel of a nozzle having a converging-/diverging or converging geometry that is transporting high-temperature gas at flow velocities ranging from high subsonic through supersonic. The gas disintegrates the liquid and entrains the resultant droplets in a highly directed two-phase (or multiphase) flow. For metals, in-flight convection cooling of the droplets followed by conduction and convection cooling at the substrate results in rapid solidification of the deposit. This restricts grain growth and improves product homogeneity by reducing the segregation of impurities. The shape of the spray-formed object is largely dictated by the geometry of the substrate or pattern onto which the spray is deposited, allowing complex shapes to be readily produced. The device has been used to produce spray-formed products of metals, polymers, and polymer/metal matrix composites having a wide variety of shapes and applications. Multiple nozzles, or multiple liquid feed ports on a single nozzle, are utilized for co-depositing more than one metal, ceramic, or polymer. Aerosols containing solid particles are pressure-fed into the nozzle with a molten metal or polymer when spray-forming particulate reinforced metal and polymer matrix composites.

Briefly, then, the present invention comprises a means and method for pressurized feed injecting of a molten metal, polymer, or metal/polymer matrix composite liquid material into a pressurized gas flow which atomizes and accelerates the molten metal droplets toward a desired substrate. The means and method of injecting the molten metal into the pressurized gas flow provide a more efficient atomization of the liquid metal into suitable droplets as well as a uniform and controllable liquid feed behavior. The molten-metal injection delivery may be timed (pulsed) to provide a repeatable batch delivery of atomized metal droplets to a desired substrate.

The means and methods of controlled molten-metal injection into pressurized gas flow of the invention includes injecting the molten metal to any desired portion of the pressurized gas nozzle, such as, for instance, any predetermined distance from the nozzle discharge or the input gas flow to the nozzle, any predetermined injection area across the radial cross-section of the nozzle, and in any direction relative to the pressurized gas flow. Preferred embodiments of the invention then encompass injecting the pressurized metal into the nozzle, throat, downstream of the throat, or upstream of the throat in the direction of the gas flow, 180° out of phase with the direction of the gas flow, and any angle of incidence with the gas flow therebetween. Preferred embodiments of the invention also include reducing the pressure within the liquid reservoir sufficient to interrupt the flow of liquid and interrupt the injection of liquid into the pressurized gas flow to provide for timed/pulsed batch deposition.

Other objects, advantages, and capabilities of the present invention will become more apparent as the description proceeds.

BRIEF DESCRIPTION OF THE DRAWINGS

The invention may be better understood and further advantages and uses thereof may become more readily apparent when considered in view of the following detailed description of the exemplary embodiments, taken with the accompanied drawings, in which.

DETAILED DESCRIPTION OF THE PREFERRED EMBODIMENTS

Figure 1:
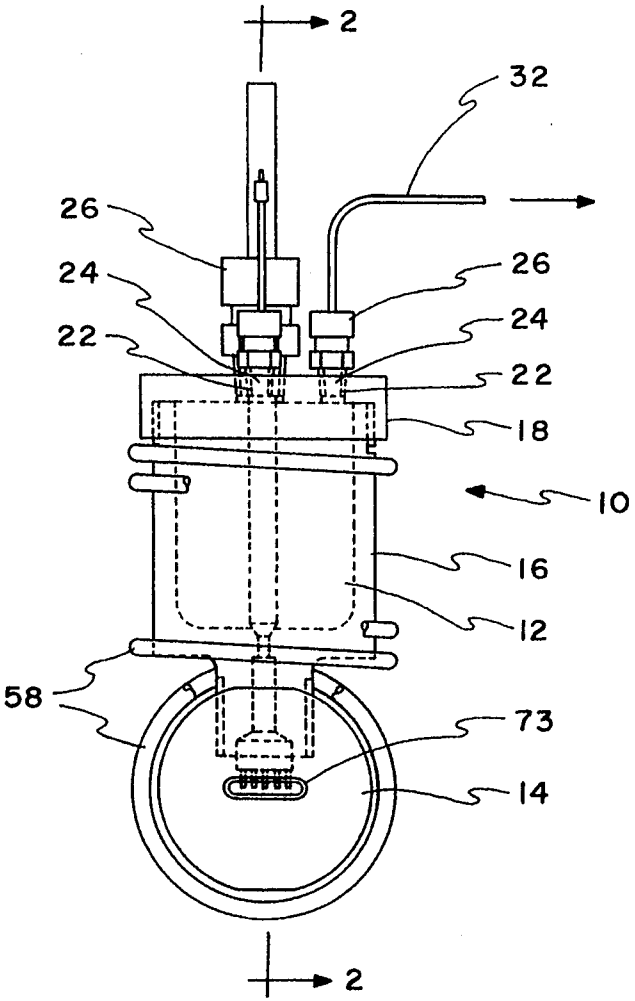
FIG. 1 is a front, partial-elevation view of the pressurized injection-feed spray apparatus constructed according to the teachings of the invention.

Referring now to the drawings and to FIGS. 1–4, in particular, there is shown a front partial-elevational view of a pressurized liquid injection-feed spray-forming apparatus and three side section views of converging/diverging (FIG. 2), converging (FIG. 3), converging/diverging but with a different feed location (FIG. 4) spray nozzle embodiments of the invention, taken along the lines 2—2 of FIG. 1, respectively. Pressurized liquid injection-feed spray-forming apparatus 10 includes a pressurizable liquid reservoir 12 and spray nozzle 14. Pressurizable liquid reservoir 12 includes body 16 and lid 18 which has multiple passages 22 fitted with suitable leak-type fittings 24 and couplings 26, so as to allow pressurized conduits, such as, for instance pressuring means 27, inert-gas inlet tube 28 valve 29 (FIGS. 1, 2, and 4), pressure tap 32, thermocouple's 34 instrumentation wires 36, and stopper rod 38. Stopper rod 38 is in mechanical communication with feed-injection valve 42, which fits in interruptible fluid communication with valve seat 44. Spray nozzle 14 includes body 16 having a gas-flow channel 46 passing therethrough. Gas-flow channel 46 has a predetermined architecture which will be described later. Liquid-orifice inlet 48 is in fluid communication with valve seat 44 through conduit 52 such that, when feed-injection valve 42 is opened, reservoir fluid 54 flows into flow channel 46 and is atomized by the gas flow therein producing spray pattern 56. Both liquid reservoir 12 and spray nozzle 14 are circumvented by heaters 58, the operation of which will be described later.

Again, referring to FIGS. 1–4, the main components of the pressurized feed-injectant spray apparatus 10 of the invention, then, are the pressurizable liquid reservoir 12 and the spray nozzle 14. Each is independently heated to the desired temperature by heaters 58 using conventional methods such as resistance heating, induction heating, electron bombardment heating, etc. The nozzle body is heated to prevent the liquid from freezing before entering the gas flow channel where atomization occurs. Conventional heating methods are also used to control the temperature of the atomizing gas over a wide range of temperatures. Depending upon the application, gas temperatures ranging from room temperature to above the melting point of the sprayed liquid have been used.

The liquid reservoir and lid are sealed using a heat-resistant gasket 62 which allows the reservoir to be pressurized or evacuated. The liquid reservoir and nozzle are sealed in a similar way using a heat-resistant gasket 64 that is compatible with the liquid to be sprayed as well as the materials of the nozzle and liquid reservoir at the operating temperature. The reservoir's lid contains fittings used to provide leak-tight couplings for inert-gas inlet tube 28, a pressure tap 32 for measuring the pressure of the gas within the reservoir, a thermocouple 34 for measuring the temperature of the liquid, and a stopper rod 38 for starting/stopping the flow of liquid to the nozzle. The inert-gas inlet 28 is used to generate a positive pressure or vacuum above the liquid as desired. This allows control of the feed rate of liquid into the nozzle and control of the atmosphere that the liquid is exposed to. A positive pressure is used to increase the liquid flow rate into the nozzle, and a partial vacuum is used to reduce or prevent the flow of liquid.

Figure 2:
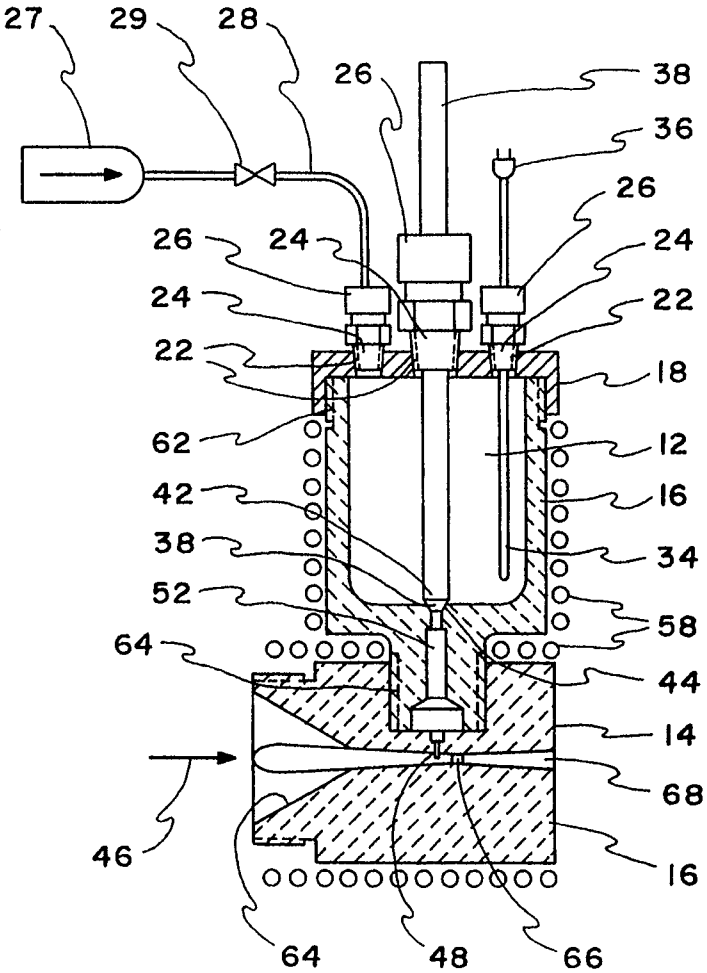
FIG. 2 is a side section view taken along lines 2—2 of FIG. 1 illustrating a converging/diverging spray nozzle having a liquid inlet in the converging portion of the nozzle.
Figure 3:
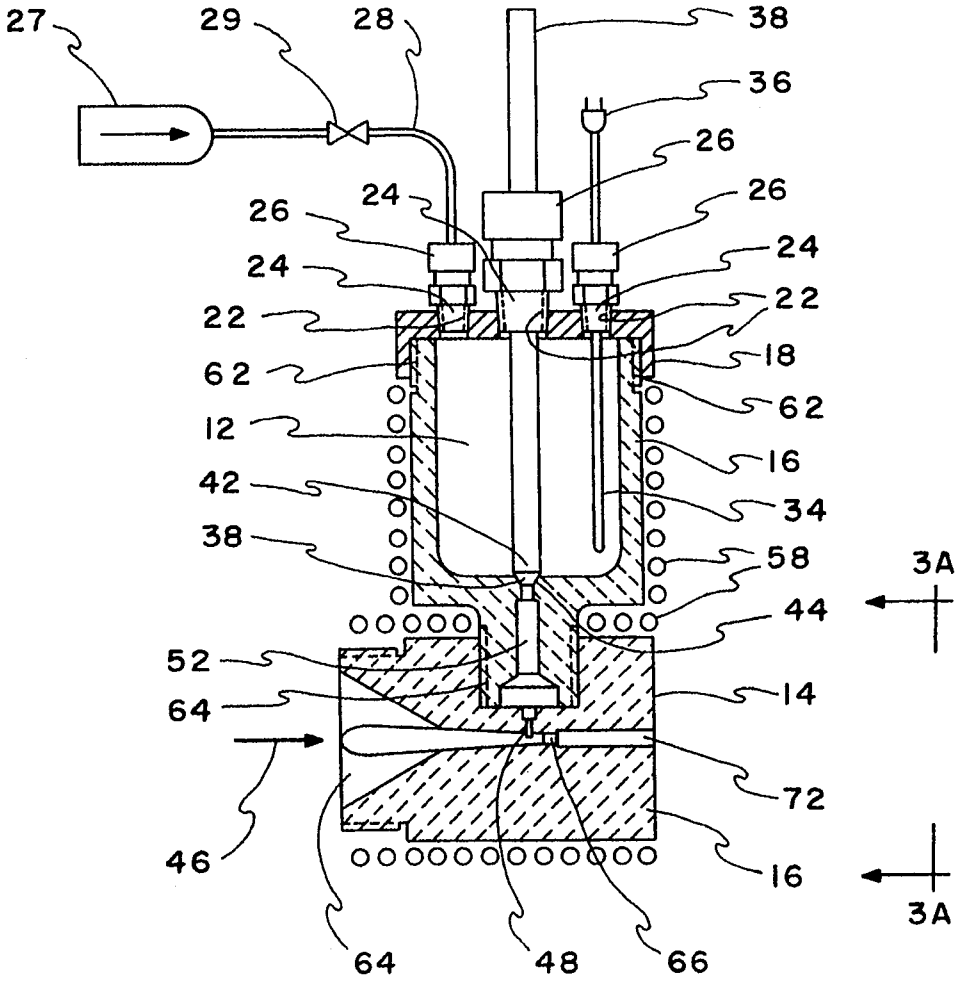
FIG. 3 is a side section view taken along lines 2—2 of FIG. 1 illustrating a converging spray nozzle embodiment of the invention.
Figure 3A:
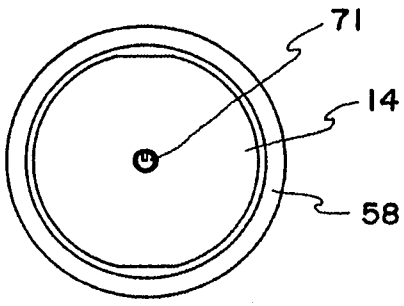
FIG. 3A is a front elevation taken along lines 3A—3A of FIG. 3

The flow channel 46 of the spray nozzle 14 may have a converging section, a constricted section or "throat" 66, and a diverging exit channel 68 (FIGS. 2 and 4) or a straight-walled exit channel 72 (FIG. 3). The former is referred to as a "converging-diverging" design while the latter is a "converging" design. Converging/diverging nozzles having included converging and diverging angles of up to 40° have been designed, constructed, and tested. Cross-sections of the nozzle along the length of the flow channel may be circular 71 FIG. 3A, i.e., the flow channel of the nozzle may have an axis of symmetry down its center along the length of the flow channel or "rectangular" ("linear") as at 73 (FIG. 1), in which case the flow channel has a vertical plane of symmetry down the center of the nozzle along its length. FIG. 1 illustrate nozzles with "rectangular" cross-sections.

Figure 4:
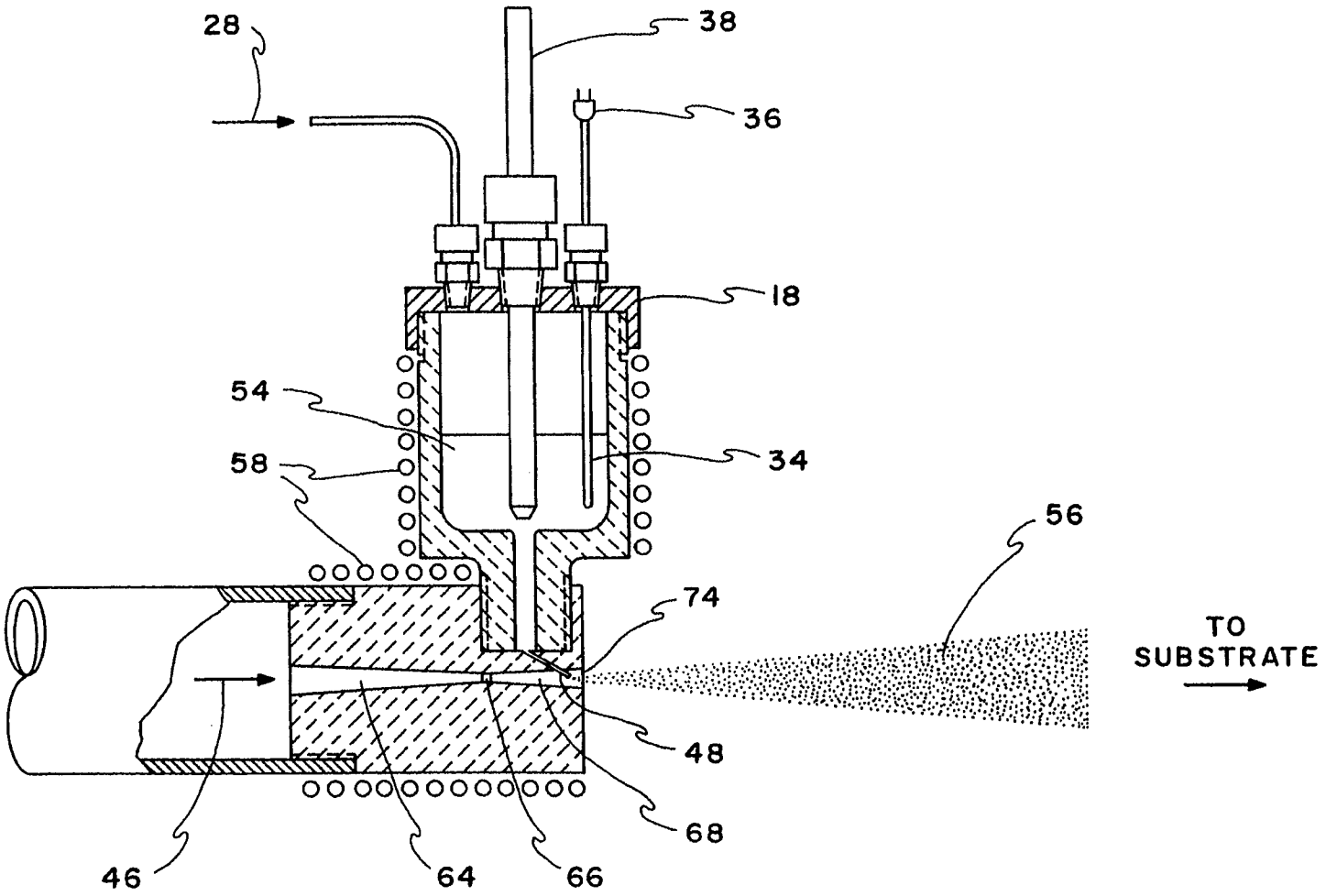
FIG. 4 is a side section view taken along lines 2—2 of FIG. 1 again illustrating a converging/diverging nozzle having a liquid inlet in the diverging portion of the nozzle architecture, and showing liquid contained in the reservoir and the liquid flow through the liquid orifice down to the spray nozzle and the spray pattern resulting therefrom.
Figure 21:
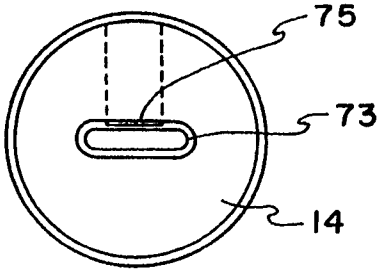

The liquid to be sprayed is fed into the nozzle 14 from the liquid reservoir through a liquid orifice inlet 48 which may be, for example, a single tube, a series of tubes, or a linear single-slit orifice 75 of FIG. 21 with predetermined orientations relative to the gas flow that spans the width of the flow channel 46. The termination point of these tubes (or slits) can be located anywhere along the length of the nozzle 14 or within the flow channel 46, and need not be located near the nozzle's throat or constriction. FIGS. 2 and 4 give two examples. In FIG. 4 the acute angle liquid inlets 48 are located near the nozzle's exit 74 to prevent accumulation of the liquid on the walls of the nozzle which would reduce the atomization efficiency. The liquid inlets are usually located where the gas velocity is high to enhance the atomization efficiency. This is possible with the present invention because the flow rate of liquid into the nozzle can be decoupled from the flow rate of gas (or nozzle pressure) through the nozzle by adjusting the pressure inside the liquid reservoir. In principle, any gas-to-liquid mass ratio (G/L) can be achieved by adjusting the flow rate of atomizing gas (nozzle pressure) and liquid reservoir pressure. Choice of liquid inlet dimensions is dictated by desired spray properties such as liquid throughput and G/L. G/L influences the atomization efficiency, increasing the efficiency as G/L increases. In general, for a given throughput, the use of smaller diameter, liquid-inlet tubes (or slit) increases the atomization efficiency. The liquid inlet tubes (or slit) are subject to clogging when they are located within the flow channel as illustrated in FIGS. 2–4. This is due to heat sinking by the surrounding atomizing gas. This condition is circumvented by heating the atomizing gas near the melting point of the sprayed metal. Alternatively, the liquid-inlet tubes (or slit) can be heated using conventional heating techniques, such as resistance heating, to maintain the liquid in a fluid state. A ceramic filter is also often used at the inlet to the liquid-inlet tubes (slit) to prevent clogging from slag or other impurities which may be present in the liquid metal. The liquid reservoir and nozzle are constructed using materials that are compatible with the liquid to be sprayed. Generally, refractory ceramics, such as boron nitride, alumina, and zirconia, are suitable. Some metals are also suitable construction materials for certain applications. Choice of atomizing gas is guided by its physicochemical properties and cost. Normally, a gas that is compatible with the components of the invention and the sprayed liquid is used. Examples include argon, helium, nitrogen, and air. Under some circumstances, however, a controlled reaction between the liquid and atomizing gas is desirable. An example is the use of nitrogen gas when atomizing low-carbon steel alloyed with aluminum. Improvements in the mechanical properties of the spray-formed product are observed due to the formation of aluminum nitride particles which presumably serve as grain-boundary pinning sites that help refine the steel's microstructures. The atomizing gas may also be seeded with reactive species, such as the halogen gases, to initiate polymerization reactions when spray-forming certain polymers.

Liquid metals including various tin alloys, zinc allows, aluminum alloys, brasses, bronzes, copper alloys, stainless steels, carbon steels, and others have been successfully spray-formed using the method and apparatus of the present invention despite the broad differences in the physical properties of these liquid metals.

Figure 19:
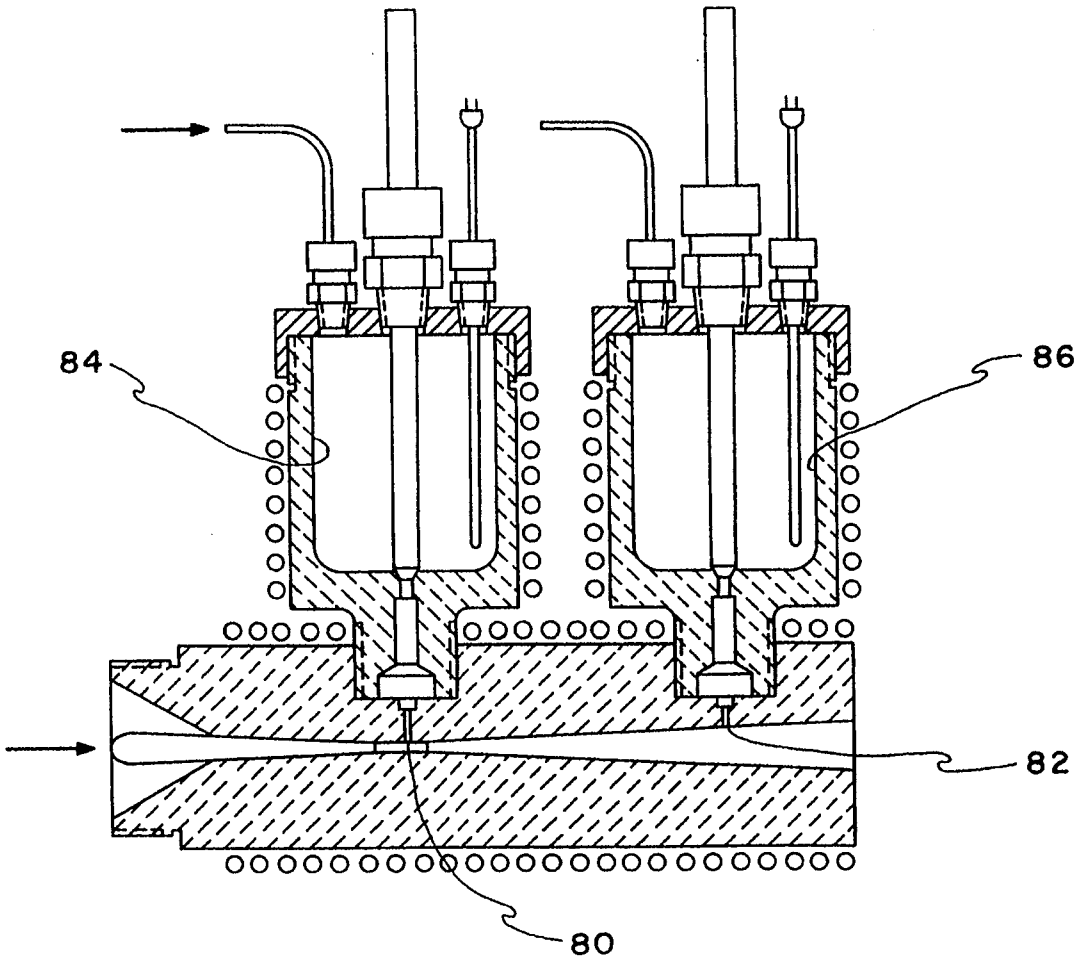
FIG. 19 is a side-section view of a multiple liquid metal disposition apparatus.

Multiple liquid metals or polymers are co-deposited by pressure feeding the metals into a single nozzle using multiple feed ports 80 and 82 and pressurizable liquid reservoirs 84 and 86 (FIG. 19) or by using multiple spray nozzles. Polymeric materials are spray-formed using several approaches. Polymers dissolved in an appropriate solvent can be readily sprayed. Control of gas temperature provides a convenient method for varying the evaporation rate of the solvent. Another approach is to melt and pressure feed the polymer into the spray nozzle. A third approach involves in-flight melting (via heated gas) of powdered polymers fed into the nozzle in aerosol form. Metal-matrix and polymer-matrix composites are spray formed by co-depositing the ceramic phase with a metal or polymer, respectively. The ceramic phase is introduced into the nozzle as an aerosol. Typically, this phase is introduced upstream of the entrance location of the metal or polymer. The atomizing gas is used to heat the ceramic phase to the desired temperature. Independent control of both the atomizing gas and liquid metal (or polymer) temperatures allows control of the extent of ceramic matrix interfacial reactions, surface wetting, and bonding.

During a typical spray-forming trial with a molten metal, metal is added to the reservoir and heated above its melting point to the desired temperature while maintaining a purged inert gas atmosphere within the reservoir. Simultaneously, the spray nozzle is heated to near the melting point of the metal to prevent solidification of the melt, and the atomizing gas is heated to the desired temperature. After the nozzle and liquid reservoir pressures are set for the desired spray conditions, the stopper rod is lifted. Liquid metal flows through the liquid orifice(s), which are shown in FIG. 2, by way of example, as a series of tubes protruding midway into the gas stream at a location upstream of the nozzle's throat. Upon contacting the high-velocity gas stream, the metal is sheared and atomized into fine droplets that are entrained in the two-phase flow and transported to a substrate or mold where they rapidly solidify to form a metal deposit. The following experimental conditions are chosen depending upon the physicochemical properties of the liquid to be sprayed, desired spray properties (droplet size, temperature, velocity, flow pattern), desired liquid throughput, desired spray formed product shape, and other considerations: nozzle geometry, liquid orifice size, shape, orientation, and location, substrate material, substrate temperature, substrate or nozzle speed, substrate shape, atomizing gas, liquid temperature, reservoir pressure, nozzle temperature, atomizing gas temperature, static gas pressure at the nozzle inlet, gas flow rate, ambient entrained gas and its temperature, and others.

SPRAY CHARACTERIZATION AND NOZZLE PERFORMANCE RESULTS

Single-Phase Flow Characterization

Figure 5:
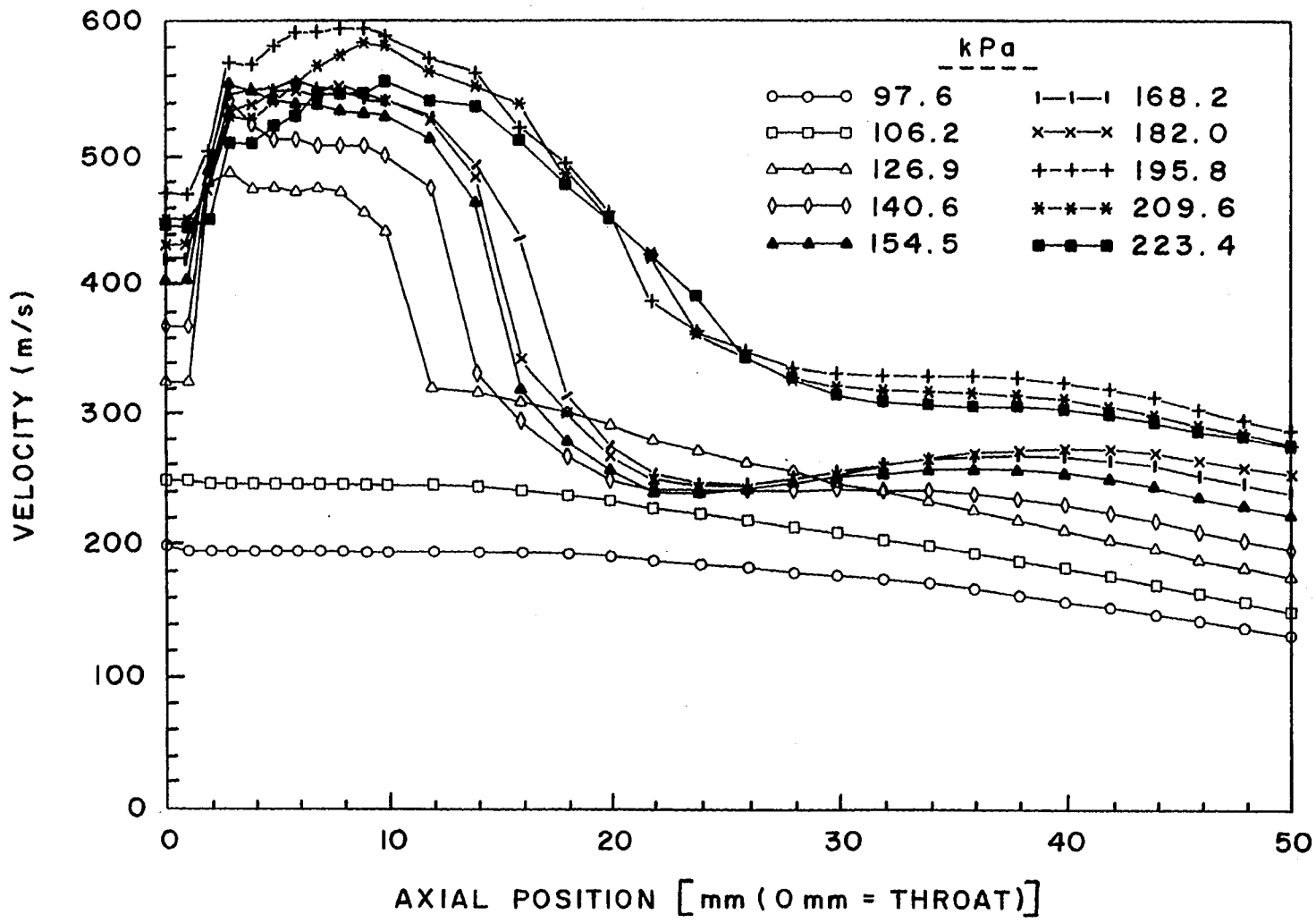
FIG. 5 is a graph showing the velocity of gas inside and external to the spray nozzle of the present invention for various nozzle-inlet pressures.

An understanding of the atomization behavior and characteristics of the flow field are important because the properties of the spray-formed product reflect the interplay of the characteristics of the spray plume (droplet size distribution, velocity, heat content, flux, and flow pattern) and substrate (material properties, surface finish, and temperature). Gas-flow field characterization studies of INEL pressurized feed-injection spray-forming nozzles have been conducted. Their single- and multiphase flow behaviors have also been extensively modelled. Flow-field diagnostics were performed using stagnation and static pressure probes constructed from small-diameter hypodermic tubing. The flow field along the centerline of the nozzle was mapped by traversing the probes from the center of the throat, through the diverging section, and into the free jet region. Gas velocities were calculated from static and stagnation pressure measurements using compressible flow theory at twelve nozzle inlet pressures. FIG. 5 summarizes results for the nozzle design shown in FIGS. 2 and 4—a converging/diverging nozzle with included inlet and outlet angles of 6°. Room temperature argon and a back pressure of about 86 kPa (12.5 psia) were used. Supersonic flows were observed downstream of the throat for nozzle-inlet pressures exceeding about 120 kPa (17.5 psia). The supersonic flow region extended about 10 mm before it began to shock down through what is believed to be a series of weak oblique shocks. The flow was driven to supersonic velocity outside the nozzle with nozzle inlet pressures in excess of about 223 kpa (32 psia).

Figure 6:
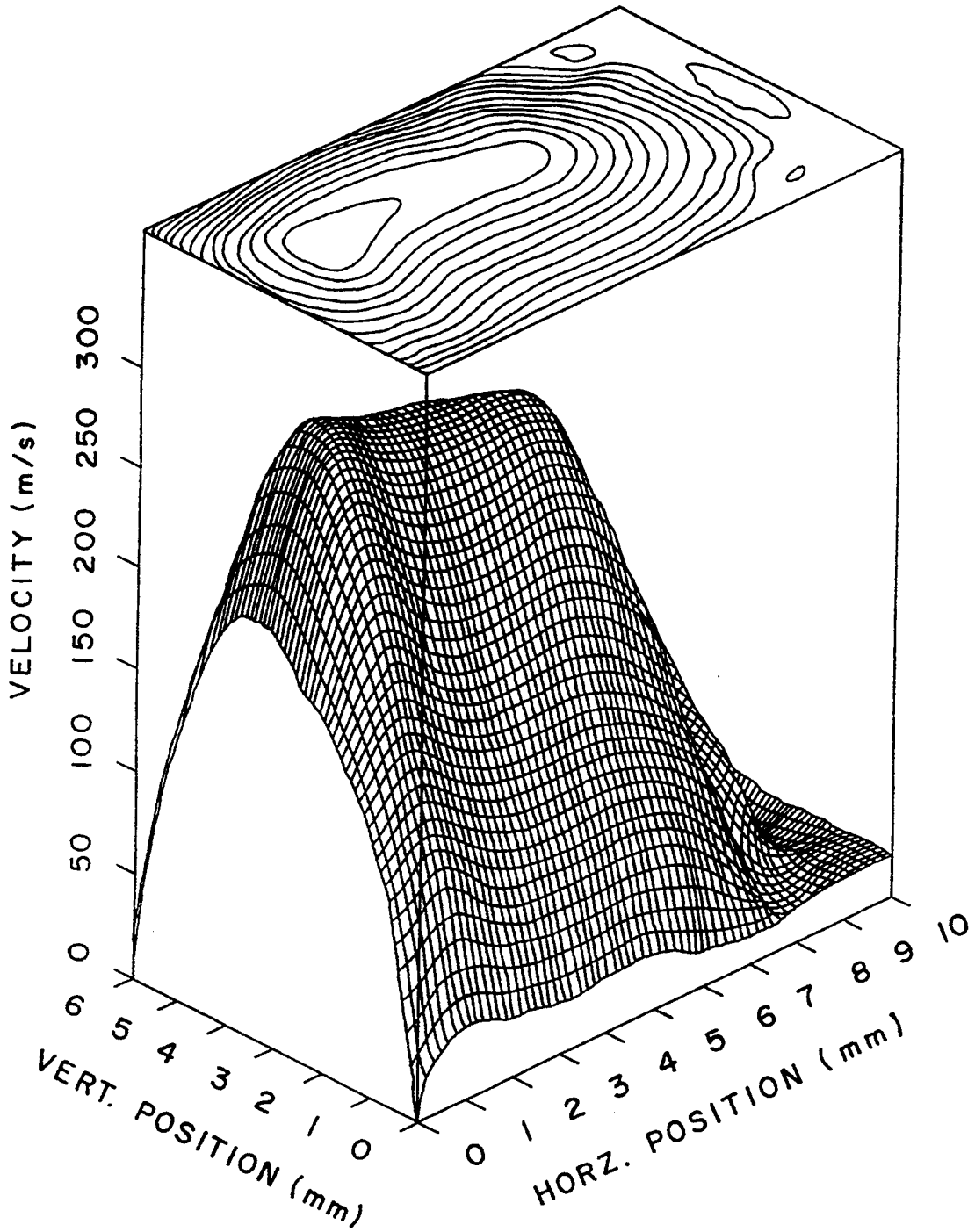
FIG. 6 is a graph showing the velocity of gas at the exit plane of the spray nozzle of the present invention for a particular operating pressure.

The flow field was also mapped at the nozzle's exit plane. Results for the velocity profile are given in FIG. 6. The profile is symmetric with no indication of flow separation. Flow separation has been observed and has been computationally verified in nozzles with excessively large divergence angles. This undesirable condition is avoided as much as possible, since it can result in poor atomization performance in terms of large, average, droplet size and a broad distribution of droplet sizes.

The magnitude and uniformity of suction, i.e., the difference between atmospheric pressure and local static pressure at the liquid orifices, were evaluated for a nozzle having inlet and exit angles (included angles) of 6° using static pressure probes placed perpendicular to the flow direction. Results using room temperature argon and a back pressure (i.e., "back pressure" is the ambient pressure at the discharge of the nozzle) of 86 kPa (12.5 psia) are given in FIG. 7. The local static pressure measured at each of six liquid orifices is plotted against the nozzle inlet pressure, giving rise to the envelope of curves. The curve profiles are parabolic-like: the pressure at the liquid orifices decreased with increasing nozzle inlet pressure from atmospheric pressure to a minimum and then increased again. The well depth, which corresponds to the magnitude of the suction, is approximately 42 kPa (6 psia). Above an inlet pressure of approximately 200 kPa (29 psia) the pressure at the liquid orifices rises above atmospheric pressure.

The suction uniformity is best at lower nozzle pressures. At high flows, the individual curves diverge with a larger reduction in suction at liquid orifices nearest the side walls (L.O. #1 and L.O. #6 in FIG. 7) due to drag effects.

Figure 7:
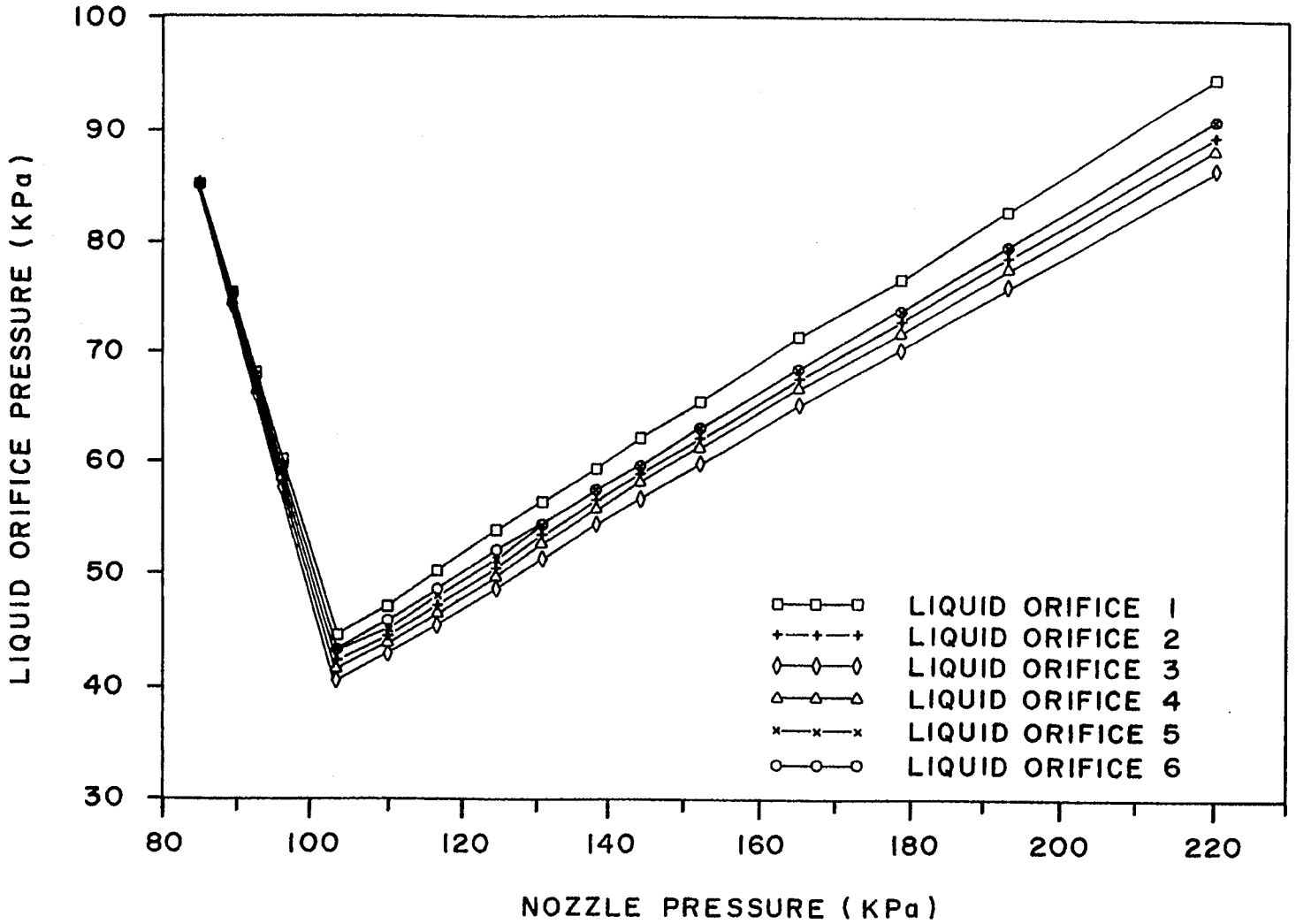
FIG. 7 is a plot of static pressure at the liquid inlets measured as a function of nozzle-inlet pressure.

As the nozzle wall and atomizing gas temperatures were increased, the depth of the well in FIG. 7 decreased, the well broadened, and the minimum was shifted slightly to lower nozzle inlet pressures. A given nozzle typically exhibited a logarithmic-like dependence of suction with temperature, with a decrease in suction of about 25% as the operating temperature was increased from 300 to 1875K. This was largely due to the increase in gas viscosity.

Operation of the nozzle in the aspiration mode (this is how U.S. Pat. No. 4,919,853' nozzle is operated) is limited to the region within the parabolic-like well in FIG. 7. This limited range of operating pressures is undesirable because it defines a limited range of gas velocities. Atomization of a liquid depends on the square of the velocity difference ($V^2$) between the atomizing gas and the liquid. Furthermore, for a given liquid orifice dimension, the flow rate of liquid into the flow channel depends on the nozzle pressure, and the flow is cut off if the pressure is too high. Atomization efficiency is influenced by the dimensions of the liquid stream entering the nozzle. In order to obtain a large liquid flow rate into an aspirating nozzle, larger liquid orifices are required or a nozzle pressure nearer the minimum in FIG. 7 is required. Both of these will result in a low gas-to-metal mass ratio and poorer atomization efficiency.

Atomization Behavior

During gas atomization, a liquid is disintegrated into relatively fine droplets by the action of aerodynamic forces that overcome surface tension forces which consolidate the liquid. The liquid's viscosity and density also influence atomization behavior but, typically, play a more secondary role. Viscosity affects both the degree of atomization and the spray pattern by influencing the amount of interfacial contact area between the liquid and gas. Viscous liquids oppose change in geometry more efficiently than low viscosity liquids, making the generation of a uniform spray jet more difficult for a given set of flow conditions. Density influences how the liquid responds to momentum transfer from the gas. Light liquids accelerate more rapidly in the gas jet. Disintegration efficiency is reduced because atomization takes place at lower relative velocities.

Liquid metals are characterized by moderately high viscosity, high density, and very high surface tension compared to common liquids such as methanol, water, and acetone. These properties, and the intrinsic high temperature requirements, make the atomization of liquid metals more difficult than with most liquids. As a result, liquid-metal spray-forming nozzles need to be designed to provide good gas/metal coupling with efficient kinetic energy transfer from the gas. With the spray-forming nozzles of the present invention, the liquid metal enters the flow channel with a low axial velocity (for the case of normal injection). There it contacts a high-velocity high-temperature inert gas. High-temperature gas is used to help maintain the liquid metal in a fluid state throughout breakup and to prevent the metal from freezing as it enters the nozzle. Relatively large droplets or sheets form initially which then undergo secondary atomization by various mechanisms depending upon local flow patterns, flow velocity, mass loading, and the physical properties of the gas and liquid metal.

The dynamics of droplet breakup in high-velocity flows are quite complicated. Historically, the Weber number, We, has been a useful predictor of breakup tendency. We represents the ratio of inertial forces to surface tension forces:

$$We = \frac{\rho V^2 D}{2\sigma}$$

where $\rho$ is the density of the gas, V is the relative velocity between the flow field (gas) and the drop, D is the diameter of the drop, and $\sigma$ is the surface tension of the drop. Breakup of liquid drops will not occur unless the Weber number exceeds a critical value, $We_{crit}$. The critical Weber number associated with the atomization of liquid tin using the nozzles shown in FIGS. 2 and 4 is estimated to be close to 1 for a nozzle operating at an inlet pressure of 207 kPa (30 psia) absolute, with argon gas heated to 300° C. $We_{crit}$ was calculated for a 14 $\mu$m droplet using the surface tension of the bulk liquid at its melting point, and the measured gas and droplet flow velocities. The density of the gas was calculated using compressible flow theory. In contrast, the Weber number associated with breakup of a 3 mm tin droplet at the liquid's injection point is estimated to be about 280 under the same nozzle conditions.

Atomization usually proceeds through stages, producing a range of droplet sizes. High-speed video techniques have been applied to examine metal breakup in spray-forming nozzles of the present design, and at least two breakup mechanisms have been observed depending upon the flow conditions and mass loading. One of these, termed "bag breakup", was observed at low-nozzle inlet pressures. "Bag breakup" has been observed in a number of studies on a variety of liquids in both steady and transient flow fields. This type of breakup, and the related "bag and stamen breakup", has been correlated with initial Weber numbers $12<We<100$. In "bag breakup", the center portion of a drop's front surface first becomes concave and then is blown out downstream to form a hollow bag attached to a more massive torroidal rim. The bag bursts, producing a shower of relatively fine droplets and filaments. Surface tension then consolidates the rim into one or more fragments which can undergo breakup depending upon the Weber number.

Another breakup mechanism, associated with higher initial Weber numbers ($100<We$), has also been observed in these nozzles. This mechanism is termed "stripping" ("sheet stripping" and "wave crest stripping" are examples) and occurs when a droplet deforms in a manner nearly opposite to "bag breakup". The drop flattens on the downstream side and presents a convex surface to the flow. Depending on the relative velocity and physical properties of the liquid, the edges of the deformed drop elongate into sheets and fine filaments or drops which later detach.

Figure 8:
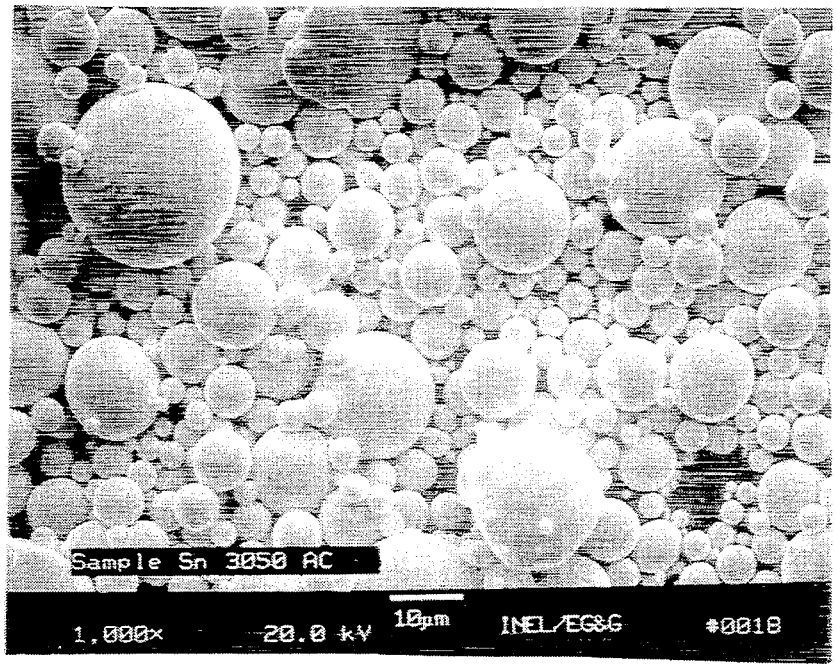
FIG. 8 is a photograph of a tin powder sample, consisting primarily of spherical particles, formed using the method and apparatus of the present invention.
Figure 9:
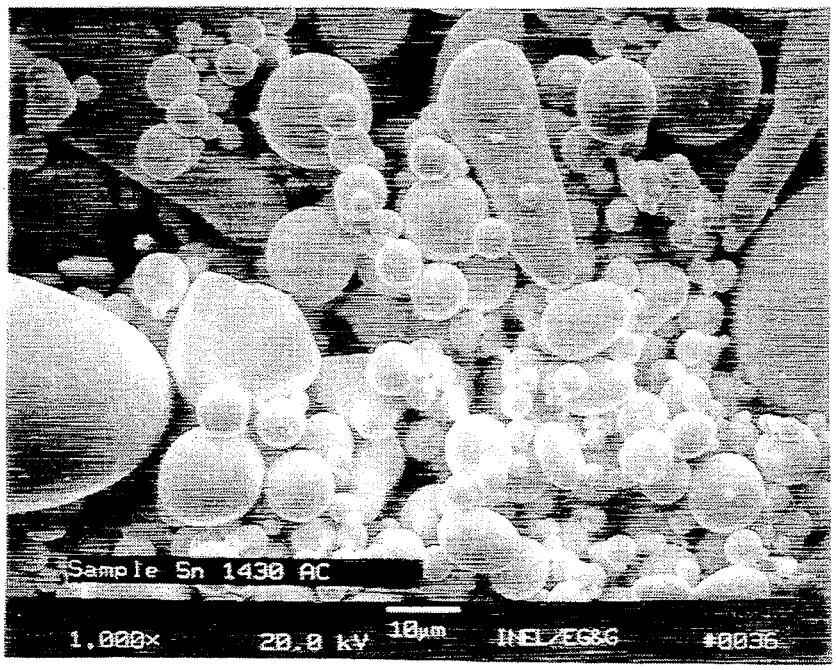
FIG. 9 is another photograph of a tin powder sample, consisting of a mixture of spherical and prolate ellipsoidal particles, formed using the method and apparatus of the present invention.
Figure 10:
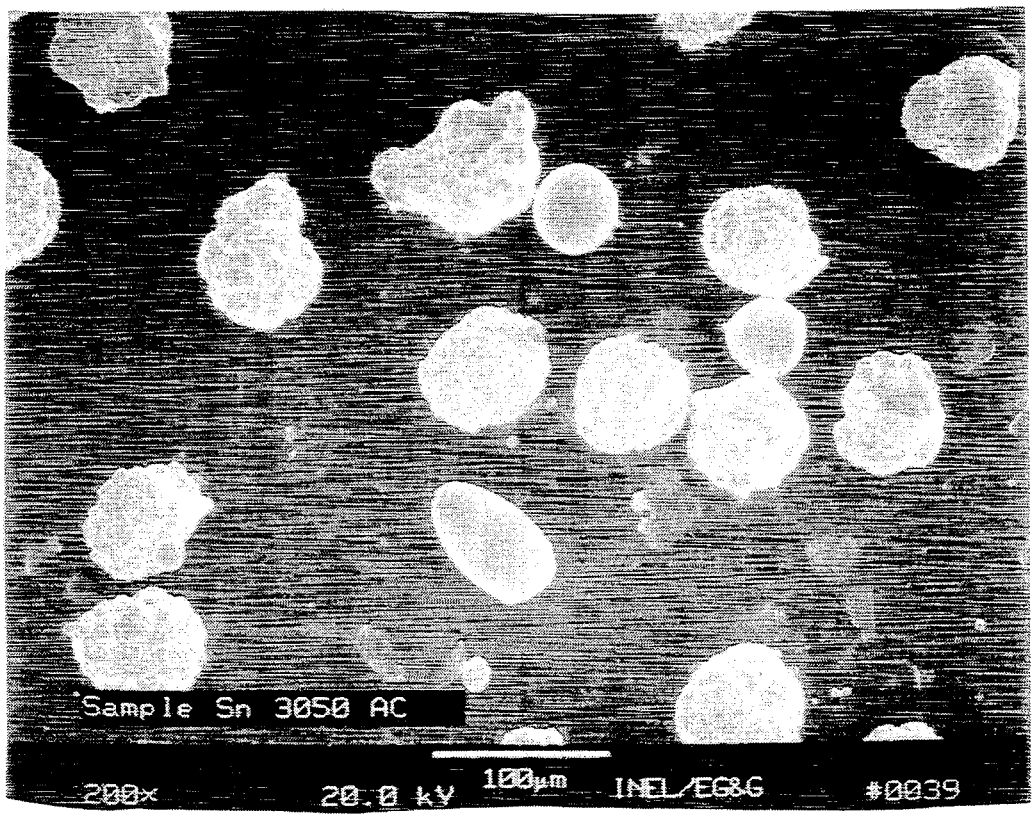
FIG. 10 is still another photograph of a tin powder sample, consisting of irregular particle shapes, formed using the method and apparatus of the present invention.

Examination of unconsolidated powders collected during spray forming with linear converging/diverging nozzles provides insight into the breakup mechanisms taking place. Normally an abundance of spherical or near-spherical shapes are found, as the SEM photograph in FIG. 8 illustrates. Other shapes have been observed, however. For example, the intermixing of prolate ellipsoidal particles with fine spherical tin particles in FIG. 9 suggests that the former resulted when liquid tin filaments, generated during "bag breakup" or "stripping", solidified in-flight The irregular powder shapes shown in FIG. 10 were formed using the same nozzle but at low gas flow rates. These large, irregular shapes are suggestive of parent droplets which began to undergo "bulgy" deformation and breakup but which were frozen in-flight. The bulges and protuberances appear larger than expected if due solely to solidification shrinkage.

In general, conditions which favor the formation of a narrow-droplet size distribution and a small, average droplet size are preferred in most spray-forming applications. The size distribution of high purity (99.8% by wt.) tin powders collected during spray-forming experiments has been evaluated using wet and dry sieving techniques. The powder was produced using a bench-scale linear converging nozzle of our own design having a 6° inlet and a transverse throat width of 17 mm. The nozzle, which was machined in-house from boron nitride stock, was operated at a pressure of 207 kPa (30 psia) with argon, heated to about 300° C. as the atomizing gas Liquid tin was super-heated about 70° C. above its melting point and pressure-fed into the nozzle through a series of liquid orifice holes that spanned the width of the nozzle. The driving pressure of the liquid was about 2.5 psia greater than ambient. The gas-to-metal mass ratio was measured to be about 10 with a metal throughput of about 0.5 kg/s per meter of nozzle throat width. The powder was collected in a chamber, passivated, and size analyzed by sieving through fine mesh screens of 300, 250, 210, 150, 125, 90, 75, 63, 53, 38, 25, 18, 15, 10, and 5 μm. Few particles larger than 125 μm were observed.

Figure 11:
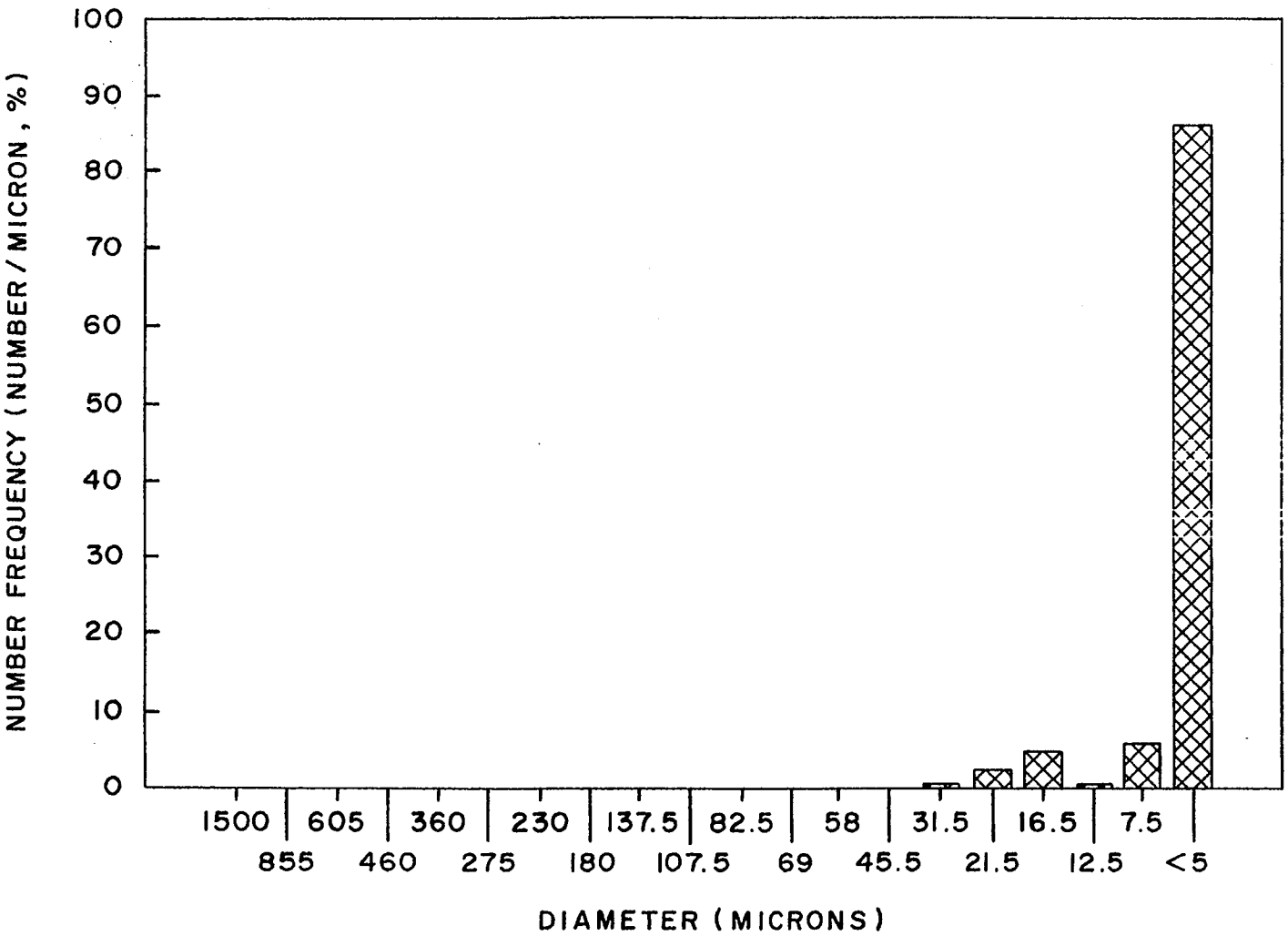
FIG. 11 is a histogram plot showing the count-frequency distribution versus powder size of tin sprayed according to the methods and apparatus of the present invention.
Figure 12:
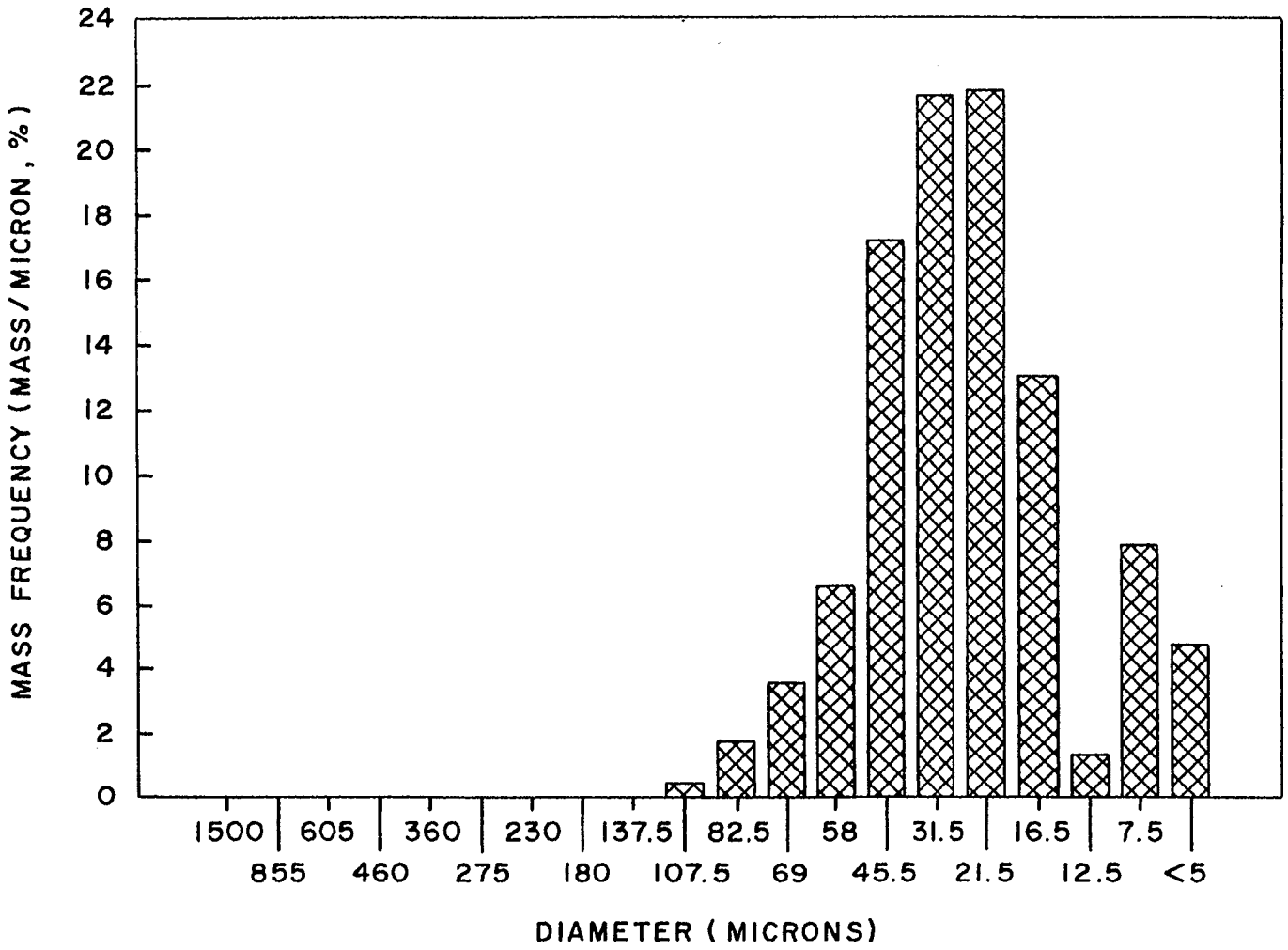
FIG. 12 is a histogram plot showing the mass-frequency distribution versus powder size of tin sprayed according to the method and apparatus of the present invention.

FIG. 11 is a histogram plot that gives the count frequency distribution versus powder size. The ordinate gives the count frequency normalized for the sieve size range, expressed as a percentage of the total counts. The plot indicates that about 85% of the powder particles were <5 μm in diameter. The average particle size was calculated to be 4 μm. The plot in FIG. 12 is a histogram plot that relates mass frequency to powder size for the same tin powder sample, again normalized for the size range of the sieves. When compared with FIG. 11, this distribution reflects the significance of the mass weighting factors (which go as $d^3$) imposed by relatively small numbers of more massive particles. Since most spray-forming applications are mass intensive, the distribution in FIG. 12 is a more representative description of the powder (and spray plume) size distribution. The Sauter (or area) mean diameter, $d_{sm}$, and volume mean diameter, $d_w$, were calculated to be 23 μm and 31 μm, respectively, using the following equations:

$$d_{sm} = \frac{\Sigma\, n_i d_i^3}{\Sigma\, n_i d_i^2}$$

$$d_{vm} = \frac{\Sigma\, n_i d_i^4}{\Sigma\, n_i d_i^3}$$

$d_{sm}$ is particularly useful in evaluating droplet sizes for surface area intensive processes, such as evaporation and heat transfer. It is sensitive-to-finer droplets while $d_{vm}$ is sensitive-to-coarser droplets. Together they give a balanced view of the powder size. The mass median diameter, $d_m$, was determined to be 23 μm by interpolation of the cumulative weight versus size data. It is the diameter corresponding to 50% cumulative weight ($d_{50}$). The geometric standard deviation, $\sigma_v=(d_{84}/d_{16})^{\frac{1}{2}}$, was calculated to be 1.5, indicating a narrow-droplet size distribution in the spray plume.

Figure 13:
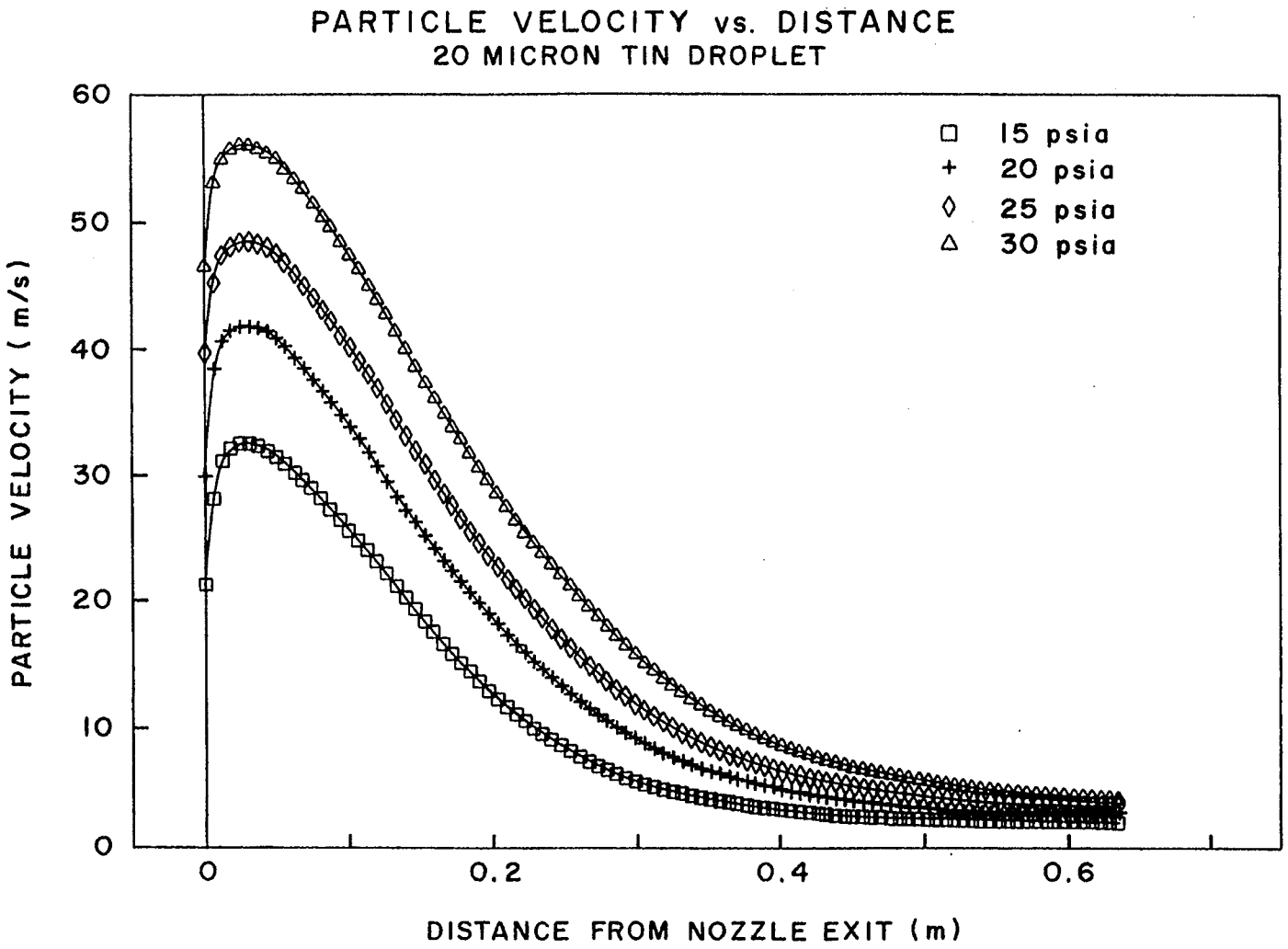
FIG. 13 is a plot that gives the calculated velocity of a 20 μm tin droplet as a function of distance from the exit of the spray nozzle of the present invention for various nozzle pressures.

In addition to controlling droplet size and shape, as described above, the present invention can be used to control droplet velocity in the spray jet. FIG. 13 gives an example. The plot gives the velocity of a 20 μm tin droplet as a function of distance from the exit of the nozzle for various nozzle pressures. The data was calculated for the converging-diverging nozzle illustrated in FIGS. 2 and 4. The tin was super-heated to 300° C. and sprayed, using argon, into a chamber with a back pressure of 12.5 psia. The spray jet entrained room temperature argon. Higher back pressures would result in more rapid deceleration of the droplets in the spray jet. Lower back pressures would result in less rapid deceleration of the droplets.

Figure 14:
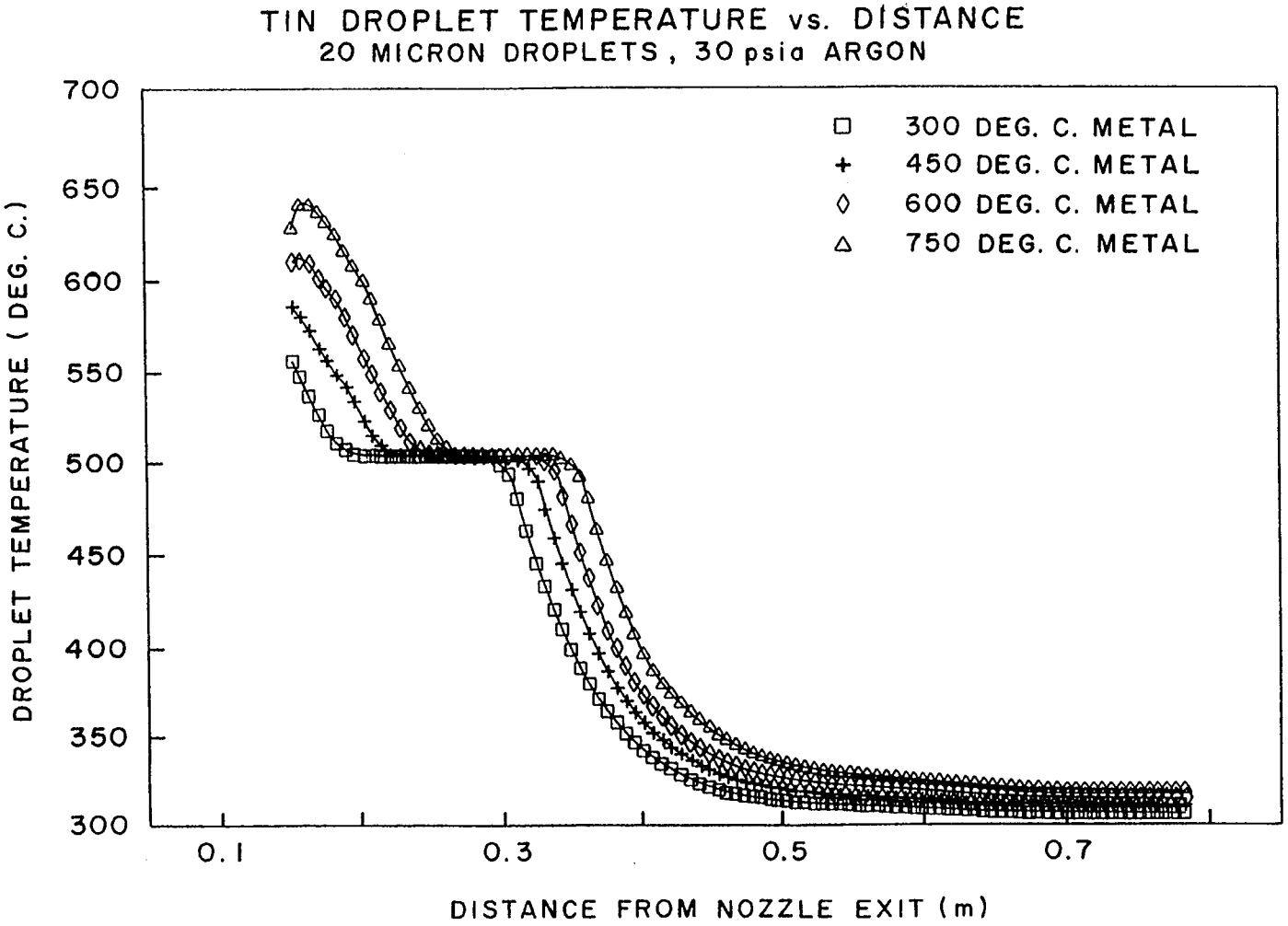
FIG. 14 is a plot that gives the calculated temperature of a 20 μm tin droplet as a function of distance from the exit of the nozzle of the present invention for various liquid-metal temperatures.

The present invention can also be used to control droplet temperature (and heat content) in the spray jet. FIG. 14 illustrates one example. The plot gives the temperature of a 20 μm tin droplet as a function of distance from the exit of the nozzle for various liquid metal temperatures. The data was calculated for the converging/diverging design of FIGS. 2 and 4. Argon gas was used at a nozzle pressure of 30 psia and a back pressure of 12.5 psia. The spray jet entrained room temperature argon. Higher back pressures, lower entrained gas temperatures, or the use of an entrained gas with a larger thermal diffusivity (e.g., helium) would result in more rapid cooling of the droplets.

The present invention can also be used to control the shape of the spray jet by engineering the shape of the flow channel of the nozzle, particularly the exit portion, or by inducing turbulence in the spray jet. For example, under similar operating conditions, spray jets produced using a converging/diverging nozzle with a small exit angle exhibit less divergence than spray jets produced with nozzles having large divergence angles. Nozzle gas velocity, mass loading, and back pressure also influence the spray jet's flow pattern and, hence, the shape of the deposit. In general, high gas velocities, low mass loadings, and low back pressures favor the formation of a more collimated spray jet. A deposit onto a flat surface is generally more gaussian (less flat) under these conditions. On the contrary, low gas velocities, high mass loadings (high liquid-to-gas mass ratios), and high back pressures favor the formation of spray jets with wider divergences. Deposits onto flat surfaces formed under these conditions are flatter having a truncated gaussian or very flat profile in cross-section. Mass loading can have a very significant effect in this regard. The liquid droplets can cause significant turbulence in the multiphase flow behavior which can result in significant divergence of the spray jet. This phenomena is favorable if the goal is to spray-form flat metal, polymer, or composite strip.

Figure 15:
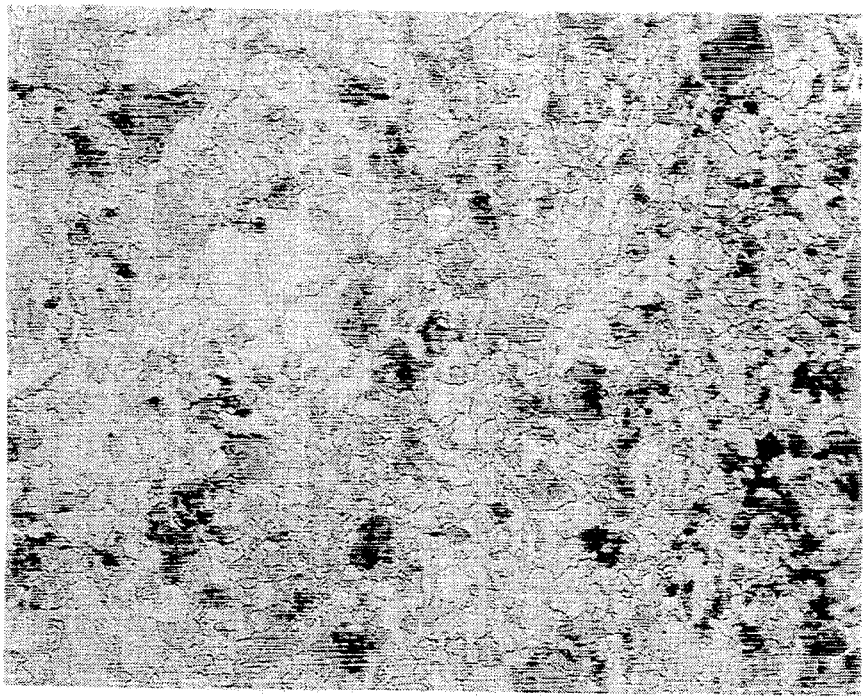
FIG. 15 is a photograph of spray-formed tin deposit produced according to the method and apparatus of the present invention.
Figure 16:
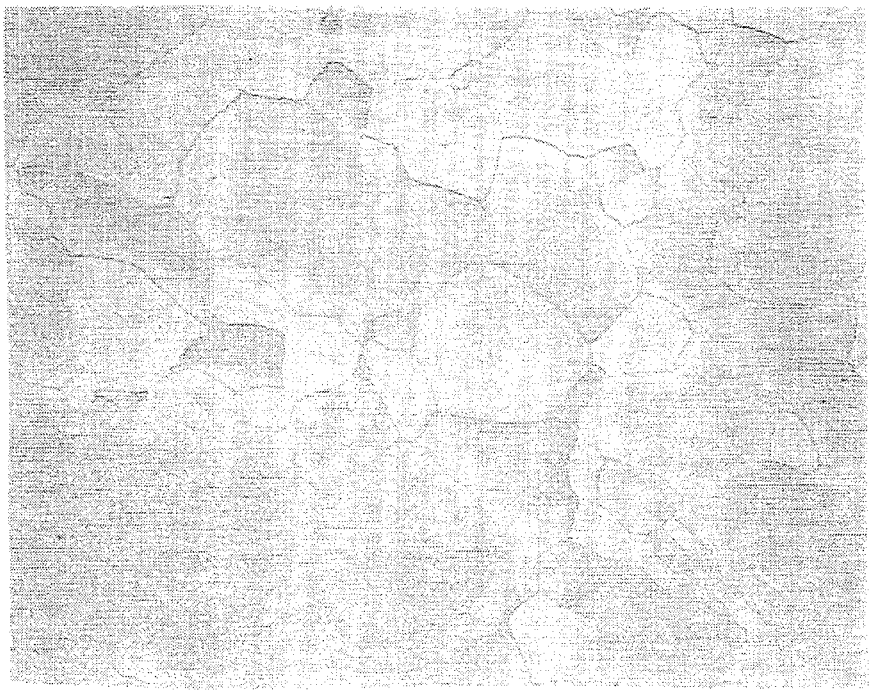
FIG. 16 is a photograph of conventionally cast tin.

Control of these spray properties (particle size, particle size distribution, velocity, particle temperature (heat content), flux, and flow pattern) is important in spray forming since the characteristics of the spray-formed product depends on these properties and those of the substrate. FIG. 15 is a photomicrograph (400×) of a tin deposit spray formed onto a room-temperature polyethylene substrate using the method and apparatus of the present invention. It is an example of the fine-grained equiaxed microstructures that can be produced—much finer than the cast tin microstructure shown in FIG. 16 (also 400×).

Examples Of The Use Of The Present Invention For Spray-Forming Other Materials

Polymers

The conditions described below were used to form thin, uniform polymer (linear polyphosphazene (PPOP)) deposits. Due to the chemical stability of the polymer, atmosphere control was relaxed and the polymer was sprayed in air using argon as the atomizing gas.

Near-net-shape deposits of PPOP were formed by directing a spray of atomized droplets of the polymer dissolved in tetrahydrofuran (THF) onto glass substrates. The spray was generated using a linear converging/diverging nozzle of our own design machined from commercial boron nitride rod. The nozzle had an entrance and exit angle (included angle) of 14°, a throat width of 0.66" transverse to the flow direction, and a throat height of 0.094". Seven percent (by weight) solution of linear (PPOP) in THF was sprayed. The weight average molecular weight of the polymer was measured to be about 750,000 amu by gel permeation chromatography. Five-percent and three-percent solutions having a polymer weight-average molecular-weight exceeding one million amu were also sprayed but were found to give less satisfactory results. The solution was warmed to 45° C. to lower its viscosity and fed into the nozzle operating at a static pressure of 137 kPa (20 psia). The solution was aspirated through six small orifices that spanned the width of the nozzle. Solution throughput was about 0.4 Kg/sec per meter of nozzle throat width. The corresponding gas-to-polymer solution mass ratio was about 4. The solution was sheared and atomized, resulting in very fine droplets that were entrained by the gas stream and transported to a moving glass substrate. Solvent molecules were shed from the atomized particles during their flight, and the remainder of the solvent evaporated at the substrate. While control of atomizing gas temperature provided a convenient vehicle for adjusting the evaporation rate of the solvent, room temperature argon was used because the equilibrium vapor pressure of THF (145 torr at 20° C.) was high enough to allow facile evaporation of the solvent. Upon impacting the substrate, individual polymer molecules within adjacent droplets interwove while shedding any remaining solvent.

The polymer/solvent spray was deposited onto 8.3 cm×8.3 cm glass plates, maintained at room temperature. The plates were swept through the spray plume to yield deposits 1 to 10 μm thick. A typical deposit covered the glass plate to a thickness of about 5 μm and was fully dried and consolidated in only about 1 sec.

Figure 17:
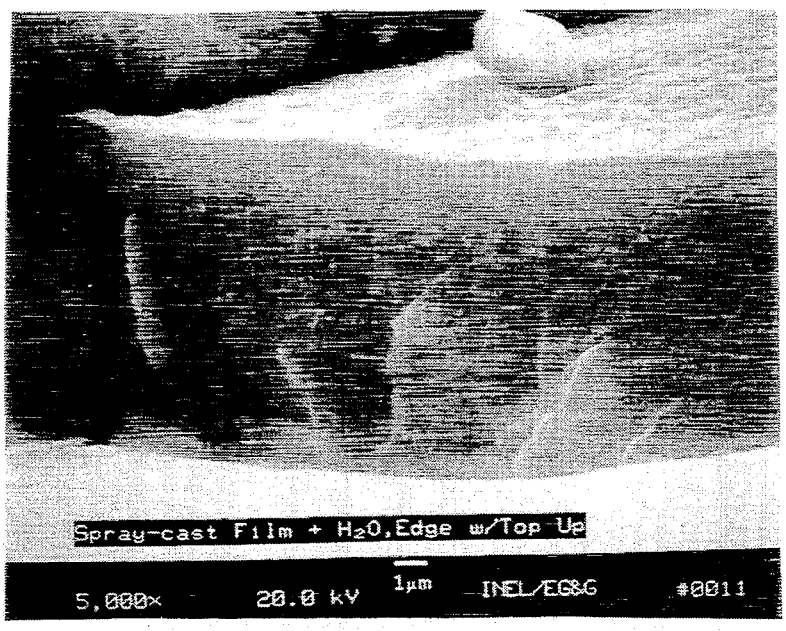
FIG. 17 is a photograph of spray-formed polymer deposit produced according to the method and apparatus of the present invention.
Figure 18:
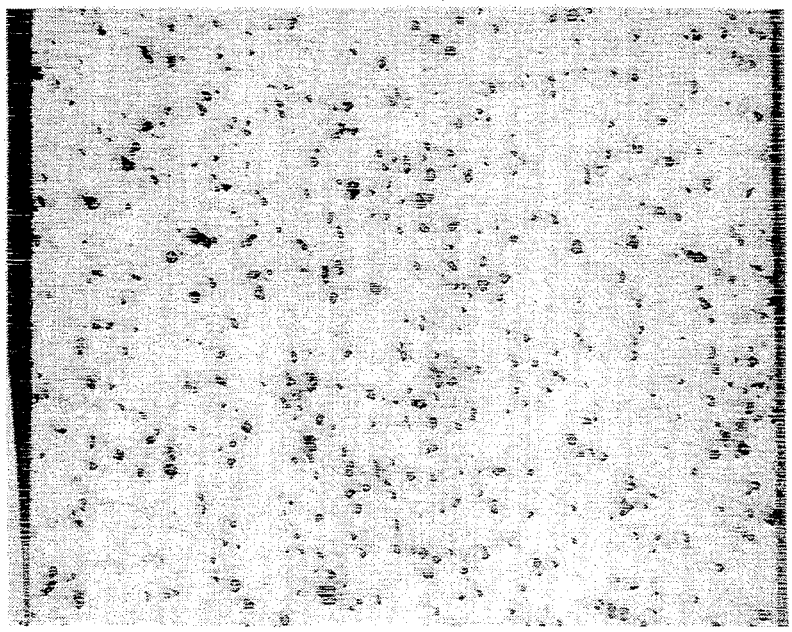
FIG. 18 is a photograph of a particulate-reinforced metal matrix composite consisting of silicon carbide particulate embedded in an aluminum 6061 alloy matrix produced according to the method and apparatus of the present invention.

SEM analysis was used to evaluate the polymer deposit's surface structure and thickness. An example is given in FIG. 17. Over the width of the glass plates the deposit appeared homogeneous and of uniform thickness. Close examination revealed that the deposit was asymmetric, with a thin, dense region at the substrate/-deposit interface and a relatively thick, uniform build-up of translucent, "spongy" polymer material away from the substrate.

Particulate Reinforced Metal Matrix Composites

Metal matrix composites (MMCs) combine metallic properties, such as high thermal and electrical conductivity, toughness, and thermal shock resistance, with ceramic properties, such as corrosion resistance, strength, high modulus, and wear resistance. The partitioning of these properties depends on the choice and volume fraction of ceramic and metal, but usually the improved properties come at some cost, such as loss of ductility and toughness relative to the matrix material. A variety of casting and powder metallurgical processing methods for particulate reinforced metal matrix composites have become available over the last two decades, and these efforts have spawned several commercial products. The development of efficient processing technologies, however, remains the greatest roadblock to large-scale commercial use of particulate-reinforced metal matrix composites. In a recent workshop sponsored by the Office of Naval Research, processing was found to be the most important area for current research and development of MMCs. Innovative development was found to be urgently needed in near-net-shape production technologies, in particular, in semifinished shapes (rods, tubes, and strip).

Figure 20:
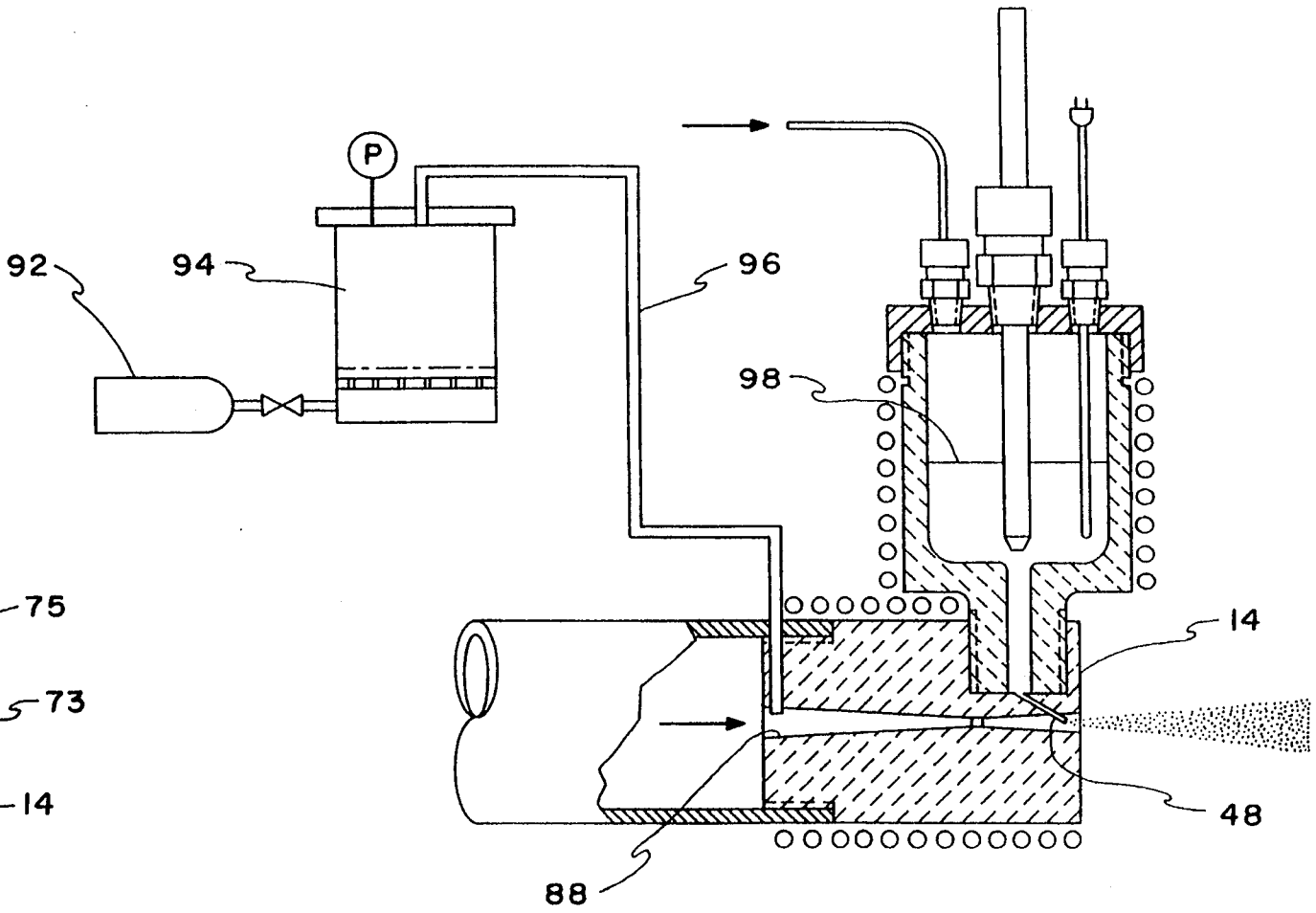
FIG. 20 is a side-section view of an aerosol injection apparatus.

Spray-forming provides a unique processing approach for particulate reinforced MMCs by offering flexibility and control of particulate volume fraction together with inherent near-net-shape and rapid solidification fabrication capabilities. Process flexibility and a reduction in the number of unit operations translates to substantial savings in time, capital equipment, and energy. The present invention provides a novel approach for producing particulate reinforced MMCs which can be seen in FIG. 20. The reinforcement phase is pressure fed into the nozzle in the form of an aerosol upstream of the entry location of the molten metal at 88. Pressurizing means 92 pressurized the solid particle reservoir 94 to discharge the aerosol gas and powder via conduit means 96 into nozzle entry 88. The particulate enters the nozzle at or near room temperature but is quickly heated by the atomizing gas to the desired temperature. The liquid metal is heated about 100° C. above its liquidus temperature, pressure fed into the nozzle, atomized, and co-deposited with the reinforcement phase. Gas and liquid metal temperature control allow control of the extent of matrix/particulate wetting and interfacial reactions. The transit time of the multiphase flow to the substrate is on the order of milliseconds. Upon impacting the substrate, matrix solidification rates are expected to be high (>103K/sec), significantly restricting macrosegregation effects which are often observed in slowly cooled cast composites. This approach, therefore, largely bypasses two major problems areas experienced in most particulate reinforced MMC fabrication methods: control of matrix/particulate interfacial reactions and wetting, and non-uniform blending caused by density differences between the matrix and reinforcement phases.

Composite strip of 6061 aluminum reinforced with SiC particulate (~13 μm diameter) was spray formed using the method and apparatus of the present invention. 6061 aluminum alloy was also sprayed without the reinforcement phase using the method and apparatus of the present invention. Particulate volume fraction in the composites ranged from 4 to 15%, as determined by acid dissolution of the matrix. Optical microscopy of polished samples indicated a uniform distribution of particulate in the matrix phase; an example is given in FIG. 17. As-deposited density of the matrix strip, measured by water displacement using Archimedes' principle, was 90 to 95% of theoretical. Photomicrographs of polished samples, however, revealed that as little as 30% thickness reduction was needed for full densification of both the composite and pure 6061 alloy materials.

As-deposited composite strip was sectioned and hot rolled at 450° C. to 80% thickness reduction. Samples were then heat treated to yield a -T6 temper. Room-temperature tensile properties were evaluated for eight samples. The composite material had small but significant (about 10%) improvements in ultimate and yield strength over commercial 6061-T6 strip, but a reduction in elongation. Ultimate tensile strength, yield strength, and elongation were as high as 337 MPa, 308 MPa, and 9.5% respectively, in the spray formed and hot rolled composite strip. The tensile strength of commercial 6061-T6 aluminum strip is typically about 310 MPa, with a yield strength of 275 MPa, and an elongation of 12%. While these preliminary results are encouraging, evaluation of a larger number of test samples is necessary to establish statistical validity.

In conclusion, then, the present invention comprises a means and method for pressurized feed-injection of molten metals, polymers, or metal/polymer matrix composites into a pressurized gas flow which atomizes and accelerates the molten metal droplets toward a desired substrate. The present invention is an improvement over the aspiration method disclosed in Alvarez.

These improvements occur because the present invention decouples the atomization and aspiration functions of the patented design, resulting in greater spray-nozzle design flexibility and enhanced atomization efficiency. Other experimentally verified improvements include: the ability to pressure-feed liquids into the nozzle at rates independent of gas flow conditions; the ability to utilize higher nozzle pressures and higher gas-flow rates; the ability to locate the liquid orifice(s) anywhere along the length of the nozzle or anywhere within the gas-flow channel; the use of smaller liquid orifice(s) for a given liquid throughput; the use of nozzle designs that improve the pattern of the multiphase flow field; and the use of the device for producing particulate reinforced and other composites.

The aspiration method is limited to a converging-/diverging design. The present invention covers converging as well as converging/diverging designs. This allows the use of gas flow channels that improve the spray pattern.

In the aspiration method, two liquid-feed methods are described: "orthogonal" and "in-line". In both cases the liquid enters the flow channel of the nozzle "at or near the choke point", i.e., the nozzle's throat This is an important difference between the two designs. The pressurized feed nozzle design allows the liquid to be fed into the nozzle anywhere within the flow channel and anywhere along the length of the nozzle, including upstream or downstream of the throat as shown in FIGS. 2 and 4 of the present invention.

Operation of the aspiration method nozzle is limited to a narrow range of operating parameters. Use of a pressurized feed allows the nozzle to be operated at virtually any nozzle pressure and gas flow rate. This is significant because atomization of a given liquid improves as the relative velocity between the liquid and the gas increases. Higher nozzle pressures and, hence, higher gas velocities are possible with the pressurized feed nozzle. Moreover, the pressurized feed nozzle allows independent control of the liquid's flow rate and the nozzle operating pressure.

The present nozzle design allows liquid-feed rate and nozzle pressure (nozzle gas-flow rate) to be completely independent. This allows the use of higher gas velocities and smaller liquid-inlet orifice(s) for better atomization.

In the aspiration method, described in U.S. Pat. No. 4,919,853, it is stated, "An important aspect of the supersonic nozzle of the subject invention is the ability to control the shape of the exiting spray. When the exit pressure equals the ambient pressure, the spray maintains the same cross section as the nozzle exit. When the exit pressure is lower, the spray converges and when the exit pressure is higher the spray diverges." In general, this simple one-to-one correspondence between exit pressure and spray shape is not observed with the present invention.

The invention described in U.S. Pat. No. 4,919,853 does mention feeding two liquids into the nozzle from separate liquid feeds (col. 6, line 25). However, there is no mention of feeding solid particulate, whiskers, or fibers into the nozzle and co-depositing the material with metal or polymers to form metal or polymer matrix composites.

While a preferred embodiment of the invention has been disclosed, various modes of carrying out the principles disclosed herein are contemplated as being within the scope of the following claims. Therefore, it is understood that the scope of the invention is not to be limited except as otherwise set forth in the claims.

What is claimed is:

1. Apparatus for injecting a pressurized liquid metal into a pressurized high subsonic through supersonic gas flow, comprising:

a. heated nozzle having a longitudinal geometry with an inlet and an outlet;

b. a source of first pressurized, heated gas at the heated nozzle inlet;

c. means for directing the gas to flow in a first predetermined direction to provide a first predetermined gas flow within the nozzle;

d. a heated liquid reservoir and a second pressurized gas to control the temperature and pressure respectively of the liquid metal to within predetermined values;

e. conduit means in fluid communication with said liquid reservoir for injecting said pressurized liquid metal into said first predetermined gas flow at a predetermined liquid metal feed port in the nozzle and the conduit means being in a second predetermined direction in the range from an acute angle to said first predetermined direction through 90° to said first predetermined direction to provide for atomizing said liquid metal with said first gas within the nozzle for deposit of said atomized liquid metal after exiting the nozzle; and f. thereby controlling metal droplet size, droplet velocity and droplet heat content to uniformly deposit said metal.

2. The apparatus of claim 1 further including valve means disposed in said conduit means for interrupting the flow of said pressurized liquid metal to provide for a pulsed injection of said pressurized liquid metal into said first pressurized gas flow, wherein said second pressurized gas is in the range of ambient to 1000 psi absolute, to provide for a batch deposition of said atomized liquid in deposited layers.

3. The apparatus of claim 1 wherein said second predetermined direction is perpendicular to said first predetermined direction.

4. The apparatus of claim 1 wherein said second predetermined direction forms an acute angle with said first predetermined direction.

5. The apparatus of claim 1 wherein said liquid metal pressure is in the range of 0 to 1000 psi absolute.

6. The apparatus of claim 1 wherein the nozzle has linear transverse cross sectional geometry having a converging/diverging longitudinal geometry.

7. The apparatus of claim 1 wherein the nozzle has a converging longitudinal geometry.

8. The apparatus of claim 6 wherein the liquid metal feed port is at a predetermined point on the converging side of the nozzle's longitudinal geometry.

9. The apparatus of claim 1 wherein the liquid metal feed port is at a predetermined point on the diverging side of the nozzle's longitudinal geometry.

10. The apparatus of claim 6 further including a solid particle reservoir, aerosol pressurizing means, and conduit means for injecting said solid particles within said gas flow to provide a multiphase mixture.

11. The apparatus of claim 10 having multiple pressurizable reservoirs to provide for co-depositing multiphrase mixtures selected from the group consisting of liquid metals and ceramics, metals and polymers, and ceramics and polymers.

12. The apparatus of claim 1 wherein said liquid feed port is a single slit orifice that spans the width of the nozzle and can be oriented in the second predetermined direction relative to the gas stream.

13. Apparatus for injecting a pressurized liquid polymer into a pressurized high subsonic through supersonic gas flow, comprising:

a. a source of first pressurized, heated gas at a heated nozzle inlet;

b. means for directing the gas to flow in a first predetermined direction to provide a first predetermined gas flow within the nozzle;

c. a heated liquid reservoir and a second pressurized gas to control the temperature and pressure respectively of the liquid polymer to within predetermined values; and d. conduit means in fluid communication with said liquid reservoir for injecting said pressurized liquid polymer into said first predetermined gas flow at a predetermined point of entry in the nozzle and the conduit means being in a second predetermined direction in the range from an acute angle to said first predetermined direction through 90° to said first predetermined direction to provide for atomizing said liquid polymer with said first gas within the nozzle for deposit of said atomized liquid polymer after exiting the nozzle.

14. The apparatus of claim 13 further comprising a second heated reservoir with pressurizing gas to independently control the temperature and pressure of a second liquid, in addition to said liquid polymer, and a second conduit means in fluid communication with said second reservoir for injecting said second liquid into the first gas flow at a point of entry longitudinally spaced along the nozzle from said liquid polymer entry to form an atomized mixture of liquid polymer and said second liquid.

15. An apparatus for forming a matrix composite, comprising:

a. an elongated nozzle having a converging section, a diverging section and a restricted throat section coupled therebetween;

b. means for providing a pressurized gas flow along the length of said nozzle connected to said converging section;

c. a first reservoir means for storing and independently pressurizing a first component of the composite;

d. a first conduit means coupled to said first reservoir means for laterally injecting the first component of said composite into said gas flow at a point within said converging section;

e. a second reservoir means for storing and independently pressurizing a second component of the composite, wherein said second component is a liquid metal; and f. a second conduit means coupled to said second reservoir means for laterally injecting the second component into said gas flow at a point within said diverging section, whereby said first and second components are atomized, mixed in selected proportions in said pressurized gas flow and deposited as a composite.

16. The apparatus of claim 15 wherein said first reservoir is provided with a flow of pressurizing gas for transporting said first component as an aerosol.

17. The apparatus of claim 15 wherein means are provided for separately heating said second reservoir and for separately heating said elongated nozzle.

18. The apparatus of claim 13 wherein the second predetermined direction is at an acute angle to said first predetermined direction.

* * * * *